US009066182B2

(12) United States Patent
Sunaga

(10) Patent No.: US 9,066,182 B2
(45) Date of Patent: Jun. 23, 2015

(54) AUDIO PROCESSING APPARATUS

(71) Applicant: Onkyo Corporation, Osaka (JP)

(72) Inventor: Tadaharu Sunaga, Osaka (JP)

(73) Assignee: Onkyo Corporation, Neyagawa-shi (JP)

( * ) Notice: Subject to any disclaimer, the term of this patent is extended or adjusted under 35 U.S.C. 154(b) by 368 days.

(21) Appl. No.: 13/751,715

(22) Filed: Jan. 28, 2013

(65) Prior Publication Data

US 2013/0208928 A1 Aug. 15, 2013

(30) Foreign Application Priority Data

Feb. 10, 2012 (JP) ..... 2012-026760

(51) Int. Cl.

| | |
|---|---|
| ***H04R 5/04*** | (2006.01) |
| ***H04R 3/12*** | (2006.01) |
| ***H04S 3/00*** | (2006.01) |
| ***H04S 7/00*** | (2006.01) |

(52) U.S. Cl.

CPC .. *H04R 3/12* (2013.01); *H04R 5/04* (2013.01); *H04S 3/00* (2013.01); *H04S 7/30* (2013.01); *H04R 2420/01* (2013.01); *H04R 2420/03* (2013.01)

(58) Field of Classification Search

CPC ..... H04R 3/12; H04R 5/04; H04S 3/00; H04S 5/02; H04S 7/30

USPC ..... 381/123

See application file for complete search history.

(56) References Cited

U.S. PATENT DOCUMENTS

| | | | | |
|---|---|---|---|---|
| 5,440,644 | A * | 8/1995 | Farinelli et al. | 381/81 |
| 6,167,140 | A * | 12/2000 | Watanabe | 381/123 |
| 6,681,018 | B1 * | 1/2004 | Asakura et al. | 381/18 |
| 7,006,645 | B2 * | 2/2006 | Fujita et al. | 381/307 |
| 7,813,824 | B2 * | 10/2010 | Takahama | 700/94 |
| 7,978,865 | B2 | 7/2011 | Sunaga et al. | |
| 8,494,183 | B2 * | 7/2013 | Sunaga et al. | 381/123 |
| 8,861,751 | B2 * | 10/2014 | Misaki et al. | 381/123 |
| 2002/0006081 | A1 * | 1/2002 | Fujishita | 369/1 |
| 2011/0243334 | A1 | 10/2011 | Misaki et al. | |

FOREIGN PATENT DOCUMENTS

| | | |
|---|---|---|
| EP | 2375789 A2 | 10/2011 |
| EP | 2485503 A2 | 8/2012 |
| JP | 2010-183203 | 8/2010 |
| JP | 2011-229113 | 11/2011 |

* cited by examiner

*Primary Examiner* — Angel Castro

(74) *Attorney, Agent, or Firm* — Renner, Otto, Boisselle & Sklar, LLP

(57) ABSTRACT

A ZONE4 left audio signal Z4L is output without releasing a connection of a surround left speaker SSL. When determining that a playback of the ZONE4 left audio signal Z4L is set by a user manipulation, a controller 2 controls switches S11*b* and S13*b* in an on state, and controls switches S11*a*, S13*a*, and S13*c* in an off state. Accordingly, the ZONE4 left audio signal Z4L is supplied from a DSP to an amplifier 12*a* through the switch S11*b*, amplified by the amplifier 12*a*, and supplied to a surround back left/ZONE4 left SP terminal 14*b* through the switch S13*b*. A surround left SP terminal 14*a* is an output terminal dedicated to a surround left audio signal, so that the ZONE4 left audio signal Z4L can be output without releasing the connection of the surround left speaker SSL.

3 Claims, 16 Drawing Sheets

AUDIO PROCESSING APPARATUS

BACKGROUND OF THE INVENTION

1. Field of the Invention

The present invention relates to an audio processing apparatus that plays back multichannel audio data.

2. Description of the Related Art

An audio playback system including a BD (Blue-ray disc) player, an AV amplifier, and a display device is used. Audio data transmitted from the BD player to the AV amplifier is generated by encoding multichannel audio data. For example, as illustrated in FIG. 4, the multichannel audio data includes a left audio signal L, a right audio signal R, a central audio signal C, a low-frequency audio signal SW, a surround left audio signal SL, and a surround right audio signal SR. Recently HD (High Definition)-related audio formats, such as Dolby True HD, Dolby Digital Plus, and DTS-HD, which are used in a BD player, appear on the scene. A surround back left audio signal SBL, a surround back right audio signal SBR, a left outside audio signal LW, a right outside audio signal RW, a left upside audio signal LH, and a right upside audio signal RH are further added in the HD-related audio formats.

However, when amplifiers corresponding to the audio signals of all the channels are provided in the AV amplifier, it is necessary to provide the amplifiers for the total of 11.1 channels, which results in a problem in that a cost increases significantly. The same holds true for the case that, as illustrated in FIG. 7, a left-central-side audio signal LC and a right-central-side audio signal RC are added instead of any one of the extended channels (or in addition to the extended channels). The same also holds true for the case that the AV amplifier generates the extended channels in a DSP according to a listening mode.

An audio processing apparatus in FIG. 15 is conceivable for the purpose of solving the problem. According to the audio processing apparatus, in the case that the surround back left audio signal SBL and the left upside audio signal LH are included, switches S511*c* and S511*e* are controlled in an on state, switches S511*d*, S511*f*, and S511*g* are controlled in an off state, the surround back left audio signal SBL is supplied from the DSP to an amplifier 512*b* through the switch S511*c*, and the left upside audio signal LH is supplied from the DSP to an amplifier 512*c* through the switch S511*e*. Switches S513*b* and S513*e* are controlled in the on state, and switches S513*c* and S513*d* are controlled in the off state. Therefore, the surround back left audio signal SBL amplified by the amplifier 512*b* is supplied to a surround back left SP terminal 514*b*, and the left upside audio signal LH amplified by the amplifier 512*c* is supplied to a left upside SP terminal 514*d* (see Japanese Unexamined Patent Publication Nos. 2011-229113 and 2010-183203).

In the case that the surround back left audio signal SBL and the left outside audio signal LW are included, the surround back left audio signal SBL is supplied from the DSP to the amplifier 512*b* through the switch S511*c*, and the left outside audio signal LW is supplied from the DSP to the amplifier 512*c* through the switch S511*e*. The switches S513*b* and S513*d* are controlled in the on state, and switches S513*c* and S513*e* are controlled in the off state. Therefore, the surround back left audio signal SBL amplified by the amplifier 512*b* is supplied to the surround back left SP terminal 514*b*, and the left outside audio signal LW amplified by the amplifier 512*c* is supplied to a left outside SP terminal 514*c*.

In the case that the left outside audio signal LW and the left upside audio signal LH are included, the left outside audio signal LW is supplied from the DSP to the amplifier 512*b* through the switch S511*c*, and the left upside audio signal LH is supplied from the DSP to the amplifier 512*c* through the switch S511*e*. The switches S513*c* and S513*e* are controlled in the on state, and the switches S513*b* and S513*d* are controlled in the off state. Therefore, the left outside audio signal LW amplified by the amplifier 512*b* is supplied to the left outside SP terminal 514*c*, and the left upside audio signal LH amplified by the amplifier 512*c* is supplied to the left upside SP terminal 514*d*.

The audio processing apparatus can output the audio signal to a speaker disposed in other pieces of room, such as ZONE2, ZONE3, and ZONE4. A speaker terminal for a ZONE2 left audio signal is also used as the left outside SP terminal 514*c*. In the case that the ZONE2 audio signal is output, the switch S511*d* is controlled in the on state, the switch S511*c* is controlled in the off state, and a ZONE2 left audio signal Z2L is supplied from the DSP to the amplifier 512*b* through the switch S511*d*. The switches S513*b* and S513*d* are controlled in the off state, and the switch S513*c* is controlled in the on state. Therefore, the ZONE2 left audio signal Z2L amplified by the amplifier 512*b* is supplied to the ZONE2 left SP terminal 514*c* through the switch S513*c*. Alternatively, in the case that the ZONE2 audio signal is output, the switch S511*f* is controlled in the on state, the switches S511*e* and S511*g* are controlled in the off state, and the ZONE2 left audio signal Z2L is supplied from the DSP to the amplifier 512*c* through the switch S511*f*. The switch S513*d* is controlled in the on state, and the switches S513*c* and S513*e* are controlled in the off state. Therefore, the ZONE2 left audio signal Z2L amplified by the amplifier 512*c* is supplied to the ZONE2 left SP terminal 514*c* through the switch S513*d*.

A speaker terminal for a ZONE3 left audio signal is also used as the left upside SP terminal 514*d*. In the case that the ZONE3 audio signal is output, the switch S511*g* is controlled in the on state, the switches S511*e* and S511*f* are controlled in the off state, and a ZONE3 left audio signal Z3L is supplied from the DSP to the amplifier 512*c* through the switch S511*g*. The switch S513*e* is controlled in the on state, and the switch S513*d* is controlled in the off state. Therefore, the ZONE3 left audio signal Z3L amplified by the amplifier 512*c* is supplied to the ZONE3 left SP terminal 514*d* through the switch S513*e*.

A speaker terminal for a ZONE4 left audio signal is also used as a surround left SP terminal 514*a*. In the case that the ZONE4 audio signal is output, a switch S511*b* is controlled in the on state, a switch S511*a* is controlled in the off state, and a ZONE4 left audio signal Z4L is supplied from the DSP to an amplifier 512*a* through the switch S511*b*. The ZONE4 left audio signal Z4L amplified by the amplifier 512*a* is supplied to the ZONE4 left SP terminal 514*a* through a switch S513*a* by controlling the switch S513*a* in the on state.

At this point, because the speaker terminal for the ZONE4 left audio signal is also used as the surround left SP terminal 514*a*, it is necessary to connect a ZONE4 left speaker to the ZONE4 left SP terminal 514*a* in the case that the ZONE4 audio signal is output. In this case, a surround left speaker cannot be connected to the speaker terminal 514*a*. Accordingly, in the case that the surround left audio signal SL is played back without playing back the ZONE4 audio signal, it is necessary to release the connection of the ZONE4 speaker to the speaker terminal 514*a* and to separately connect the surround left speaker, which results in a troublesome procedure. Because the surround left audio signal is frequently used, it is necessary to frequently reconnect the speaker in the case that the ZONE4 is used. The reason the speaker terminal for the ZONE4 left audio signal is also used as the surround left SP terminal 514*a* is that the ZONE2 audio signal, the ZONE3 audio signal, and the ZONE4 audio signal can simultaneously be played back.

FIG. 16 illustrates another audio processing apparatus. In the case that the surround back left audio signal SBL is included, a switch S611*c* is controlled in the on state, a switch S611*d* is controlled in the off state, and the surround back left audio signal SBL is supplied from the DSP to an amplifier 612*b* through the switch S611*c*. A switch S613*c* is controlled in the on state, and switches S613*d* and S613*e* are controlled in the off state. Therefore, the surround back left audio signal SBL amplified by the amplifier 612*b* is supplied to a surround back left SP terminal 614*b* (see Japanese Unexamined Patent Publication No. 2010-183203).

In the case that the left outside audio signal LW is included, the switch S611*c* is controlled in the on state, the switch S611*d* is controlled in the off state, and the left outside audio signal LW is supplied from the DSP to the amplifier 612*b* through the switch S611*c*. The switch S613*d* is controlled in the on state, and the switches S613*c* and S613*e* are controlled in the off state. Therefore, the left outside audio signal LW amplified by the amplifier 612*b* is supplied to a left outside SP terminal 614*c*.

In the case that the left upside audio signal LH is included, the switch S611*c* is controlled in the on state, and the switch S611*d* is controlled in the off state, and the left upside audio signal LH is supplied from the DSP to the amplifier 612*b* through the switch S611*c*. The switch S613*e* is controlled in the on state, and the switches S613*c* and S613*d* are controlled in the off state. Therefore, the left upside audio signal LH amplified by the amplifier 612*b* is supplied to a left upside SP terminal 614*d*.

The speaker terminal for the ZONE2 left audio signal is also used as the left outside SP terminal 614*c*. In the case that the ZONE2 audio signal is output, the switch S611*d* is controlled in the on state, the switch S611*c* is controlled in the off state, and the ZONE2 left audio signal Z2L is supplied from the DSP to the amplifier 612*b* through the switch S611*d*. The switch S613*d* is controlled in the on state, and the switches S613*c* and S613*e* are controlled in the off state. Therefore, the ZONE2 left audio signal Z2L amplified by the amplifier 612*b* is supplied to the ZONE2 left SP terminal 614*c* through the switch S613*d*.

The speaker terminal for the ZONE3 left audio signal is also used as the surround left SP terminal 614*a*. In the case that the ZONE3 audio signal is output, a switch S611*b* is controlled in the on state, a switch S611*a* is controlled in the off state, and a ZONE3 left audio signal Z3L is supplied from the DSP to an amplifier 612*a* through the switch S611*b*. A switch S613*a* is controlled in the on state. Therefore, the ZONE3 left audio signal Z3L amplified by the amplifier 612*a* is supplied to a ZONE3 left SP terminal 614*a* through the switch S613*a*.

At this point, because the speaker terminal for the ZONE3 left audio signal is also used as the surround left SP terminal 614*a*, it is necessary to connect a ZONE3 left speaker to the ZONE3 left SP terminal 614*a* in the case that the ZONE3 audio signal is output. In this case, the surround left speaker cannot be connected to the speaker terminal 614*a*. Accordingly, in the case that the surround left audio signal SL is played back without playing back the ZONE3 audio signal, it is necessary to release the connection of the ZONE3 speaker to the speaker terminal 614*a* and to separately connect the surround left speaker, which results in a troublesome procedure. Because the surround left audio signal is frequently used, it is necessary to frequently reconnect the speaker in the case that the ZONE3 is used. The reason the speaker terminal for the ZONE3 left audio signal is also used as the surround left SP terminal 614*a* is that the ZONE2 audio signal and the ZONE3 audio signal can simultaneously be played back.

SUMMARY OF THE INVENTION

The present invention is devised in order to solve the above conventional problems, and its object is to provide an audio processing apparatus that can output a fourth room left audio signal (or a third room left audio signal) without releasing the connection of the surround left speaker.

An audio processing apparatus according to a preferred embodiment of the present invention comprises: a first amplifier that amplifies a surround left audio signal (or a surround right audio signal) or a fourth room left audio signal (or a fourth room right audio signal); a second amplifier; a third amplifier; a first speaker terminal that outputs the surround left audio signal; a second speaker terminal that outputs a first extended left audio signal (or a first extended right audio signal) or the fourth room left audio signal; a third speaker terminal that outputs a second extended left audio signal (or a second extended right audio signal) or a second room left audio signal (or a second room right audio signal); a fourth speaker terminal that outputs a third extended left audio signal (or a third extended right audio signal) or a third room left audio signal (or a third room right audio signal); a first switch that switches whether the surround left audio signal from the first amplifier is supplied to the first speaker terminal; a second switch that switches whether the fourth room left audio signal from the first amplifier is supplied to the second speaker terminal; a third switch that switches whether the amplified first extended left audio signal is supplied to the second speaker terminal; a fourth switch that switches whether the amplified second extended left audio signal or the amplified second room left audio signal is supplied to the third speaker terminal; a fifth switch that switches whether the amplified third extended left audio signal or the amplified third room left audio signal is supplied to the fourth speaker terminal; and a switching controller that controls the first switch, the second switch, the third switch, the fourth switch, and the fifth switch.

In the case that the fourth room left audio signal is output, the first switch is controlled in the off state, the second switch is controlled in the on state, and the third switch is controlled in the off state. Accordingly, the fourth room left audio signal is amplified by the first amplifier and supplied to the second speaker terminal through the second switch. The first speaker terminal is the output terminal dedicated to the surround left audio signal, so that the fourth room left audio signal can be output without releasing the connection of the surround left speaker.

An audio processing apparatus according to a preferred embodiment of the present invention comprises: a first amplifier that amplifies a surround left audio signal (or a surround right audio signal) or a third room left audio signal (or a third room right audio signal); a second amplifier that amplifies a first extended left audio signal (or a first extended right audio signal), a second extended left audio signal (or a second extended right audio signal), a third extended left audio signal (or a third extended right audio signal), or a second room left audio signal (or a second room right audio signal); a first speaker terminal that outputs the surround left audio signal; a second speaker terminal that outputs the first extended left audio signal; a third speaker terminal that outputs the second extended left audio signal or the second room left audio signal; a fourth speaker terminal that outputs the third extended left audio signal or the third room left audio signal; a first switch that switches whether the surround left audio signal from the first amplifier is supplied to the first speaker terminal; a second switch that switches whether the third room left audio signal from the first amplifier is supplied to the fourth speaker terminal; a third switch that switches whether the first extended left audio signal from the second amplifier is supplied to the second speaker terminal; a fourth switch that switches whether the second extended left audio signal or the second room left audio signal from the second amplifier is supplied to the third speaker terminal; a fifth switch that switches whether the third extended left audio signal from the second amplifier is supplied to the fourth speaker terminal; and a switching controller that controls the first switch, the second switch, the third switch, the fourth switch, and the fifth switch.

In the case that the third room left audio signal is output, the first switch is controlled in the off state, the second switch is controlled in the on state, and the fifth switch is controlled in the off state. Accordingly, the third room left audio signal is amplified by the first amplifier and supplied to the fourth speaker terminal through the second switch. The first speaker terminal is the output terminal dedicated to the surround left audio signal, so that the third room left audio signal can be output without releasing the connection of the surround left speaker.

In a preferred embodiment, the first extended left audio signal is any one of a surround back left audio signal, a left outside audio signal, a left upside audio signal, and a left-central-side audio signal (or the first extended right audio signal is any one of a surround back right audio signal, a right outside audio signal, a right upside audio signal, and a right-central-side audio signal), the second extended left audio signal is any one of the surround back left audio signal, the left outside audio signal, the left upside audio signal, and the left-central-side audio signal and is different from the first extended left audio signal (or the second extended right audio signal is any one of the surround back right audio signal, the right outside audio signal, the right upside audio signal, and the right-central-side audio signal and different from the first extended right audio signal), and the third extended left audio signal is any one of the surround back left audio signal, the left outside audio signal, the left upside audio signal, and the left-central-side audio signal and different from the first extended left audio signal and the second extended left audio signal (or the third extended right audio signal is any one of the surround back right audio signal, the right outside audio signal, the right upside audio signal, and the right-central-side audio signal and different from the first extended right audio signal and the second extended right audio signal).

The present invention includes one of the above configurations, so that the audio processing apparatus that can output the fourth room left audio signal (or the third room left audio signal) without releasing the connection of the surround left speaker can be provided.

DETAILED DESCRIPTION OF THE PREFERRED EMBODIMENTS

Figure 1:
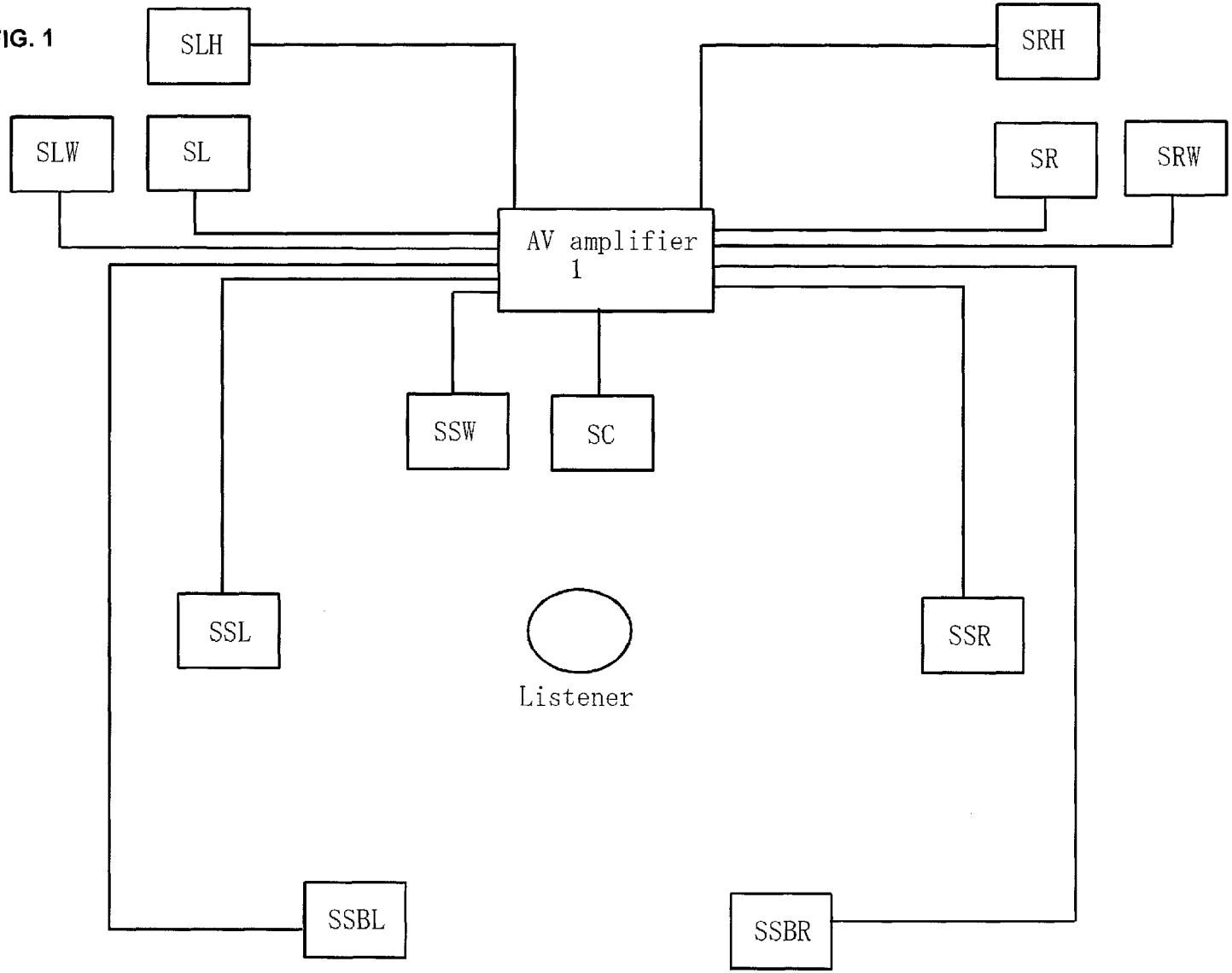
FIG. 1 is a view illustrating dispositions of an AV amplifier and speakers.

Hereinafter, an audio playback system including a disk playback apparatus (hereinafter referred to as a BD player), an audio processing apparatus (hereinafter referred to as an AV amplifier), and a display device according to preferred embodiments of the present invention will specifically be described with reference to the drawings. However, the present invention is not limited to the embodiments. FIG. 1 is a view illustrating an example of dispositions of an AV amplifier 1 and speakers according to a first embodiment. A left speaker SL, a right speaker SR, a central speaker SC, a low-frequency speaker SSW, a surround left speaker SSL, a surround right speaker SSR, a surround back left speaker SSBL, a surround back right speaker SSBR, an left upside speaker SLH, an right upside speaker SRH, a left outside speaker SLW, and a right outside speaker SRW are connected to the AV amplifier 1.

Figure 2:
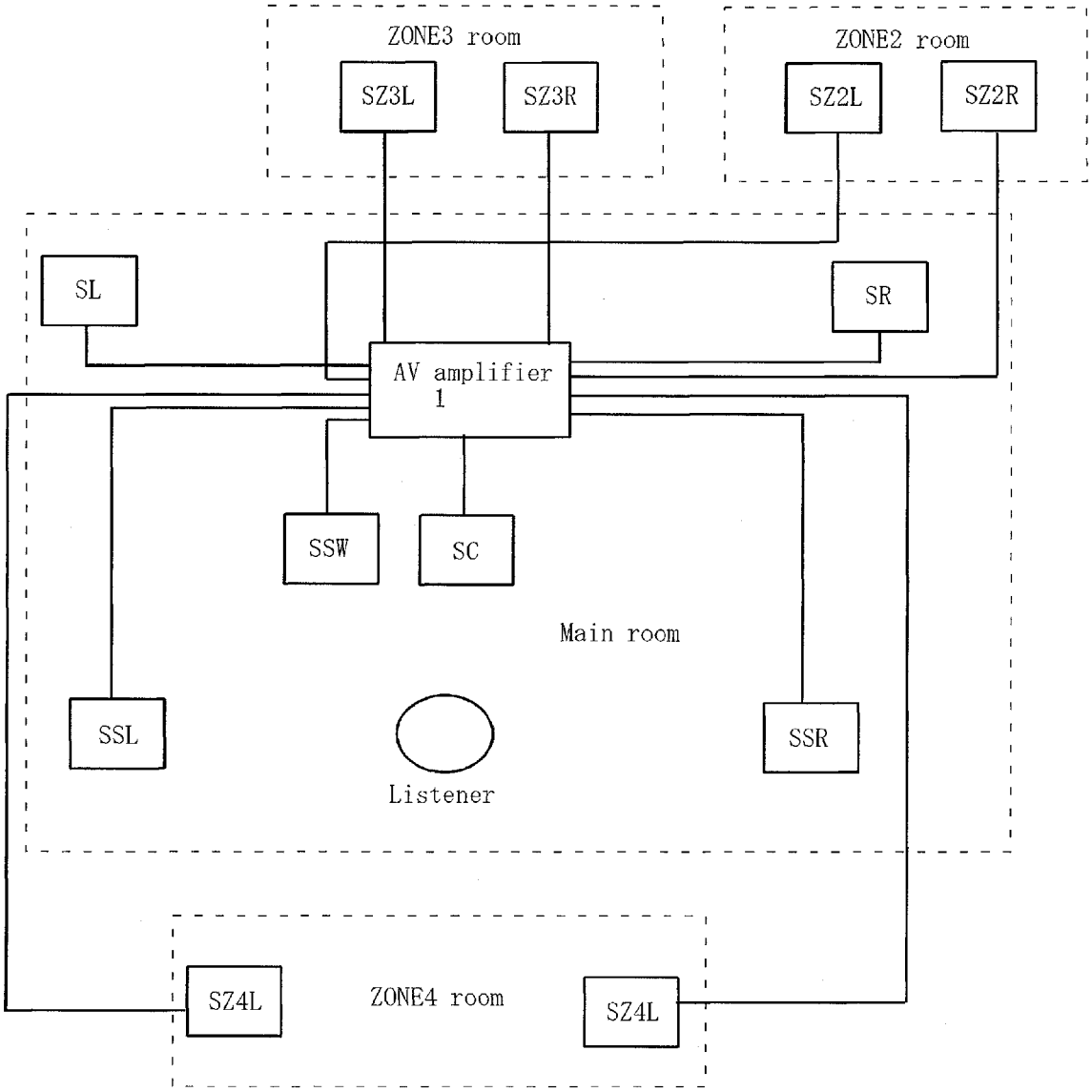
FIG. 2 is a view illustrating dispositions of the AV amplifier and the speakers.

FIG. 2 illustrates a state in which a ZONE2 left speaker SZ2L, ZONE2 right speaker SZ2R, a ZONE3 left speaker SZ3L, a ZONE3 right speaker SZ3R, a ZONE4 left speaker SZ4L, and a ZONE4 right speaker SZ4R are connected instead of the surround back left speaker SSBL, the surround back right speaker SSBR, the left upside speaker SLH, the right upside speaker SRH, the left outside speaker SLW, and the right outside speaker SRW in FIG. 1.

Figure 3:
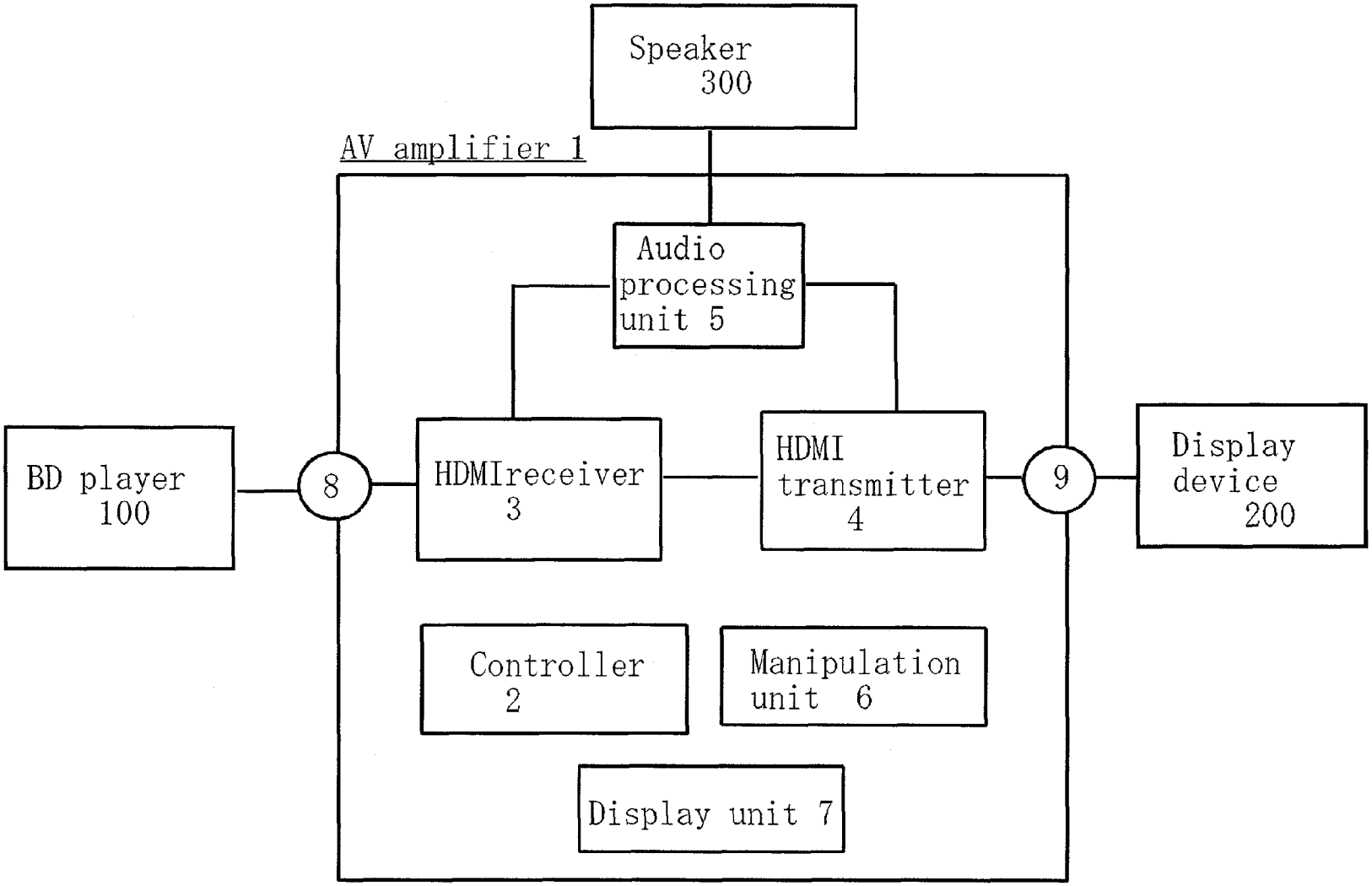
FIG. 3 is a view illustrating an audio playback system.

FIG. 3 is a block diagram illustrating a configuration of an audio playback system. For example, a BD player 100, the AV amplifier 1, and a display device 200 are compliant with an HDMI standard, and are connected to one another through an HDMI cable. The BD player 100 transmits HDMI data including multichannel audio data and video data to the AV amplifier 1. The AV amplifier 1 amplifies the multichannel audio data, which is received from the BD player 100 and included in the HDMI data, and outputs the multichannel audio data to the speakers. The AV amplifier 1 transmits the HDMI data including the video data to the display device 200. The display device 200 displays the video data, which is received from the AV amplifier 1 and included in the HDMI data.

The AV amplifier 1 includes a controller 2, an HDMI receiver 3, an HDMI transmitter 4, an audio processing unit 5, a manipulation unit 6, a display unit 7, and HDMI terminals 8 and 9. A speaker 300 (corresponding to the speakers in FIGS. 1 and 2) is connected to the AV amplifier 1.

The HDMI receiver 3 receives the HDMI data transmitted from the BD player 100, generates original video data from the received HDMI data, and supplies the original video data to the HDMI transmitter 4. The HDMI receiver 3 generates original multichannel audio data from the received HDMI data, and supplies the original multichannel audio data to the audio processing unit 5.

Figure 4:
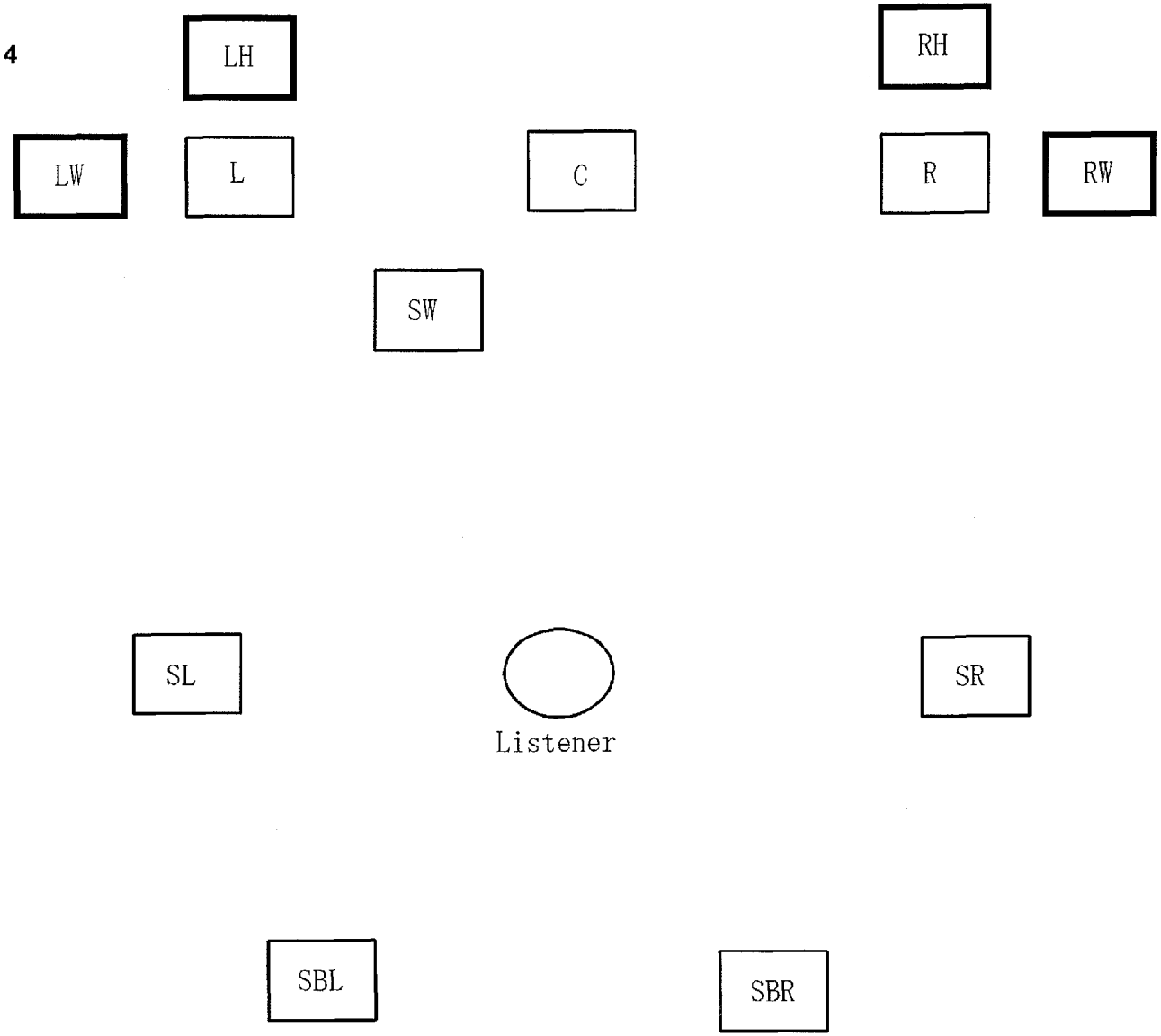
FIG. 4 is a view illustrating channels of audio signals.

The audio processing unit 5 decodes the multichannel audio data supplied from the HDMI receiver 3, performs pieces of processing, such as acoustic processing, D/A conversion processing, a volume adjusting processing, and amplifying processing, and supplies an audio signal of each channel to the speaker 300. The multichannel audio data supplied to the audio processing unit 5 will be described. As illustrated in FIG. 4, for example, HD (High Definition)-related audio formats, such as Dolby True HD, Dolby Digital Plus, and DTS-HD include a left audio signal L (front left audio signal), a right audio signal R (front right audio signal), a central audio signal C, a low-frequency audio signal SW, a surround left audio signal SL, a surround right audio signal SR, a surround back left audio signal SBL, a surround back right audio signal SBR, a left outside audio signal LW, a right outside audio signal RW, an left upside audio signal LH, and an right upside audio signal RH.

The surround back left audio signal SBL is played back from a position on a back left side of a user. The surround back right audio signal SBR is played back from a position on a back right side of the user. The left outside audio signal LW is played back from a position (that is, on a front left outside of the user) of an outside (a left side) of the left audio signal L. The right outside audio signal RW is played back from a position (that is, on a front right outside of the user) of an outside (a right side) of the right audio signal R. The left upside audio signal LH is played back from a position (that is, on a front left upside of the user) of an upside of the left audio signal L. The right upside audio signal RH is played back from a position (that is, on a front right upside of the user) of the upside of the right audio signal R.

Figure 5:
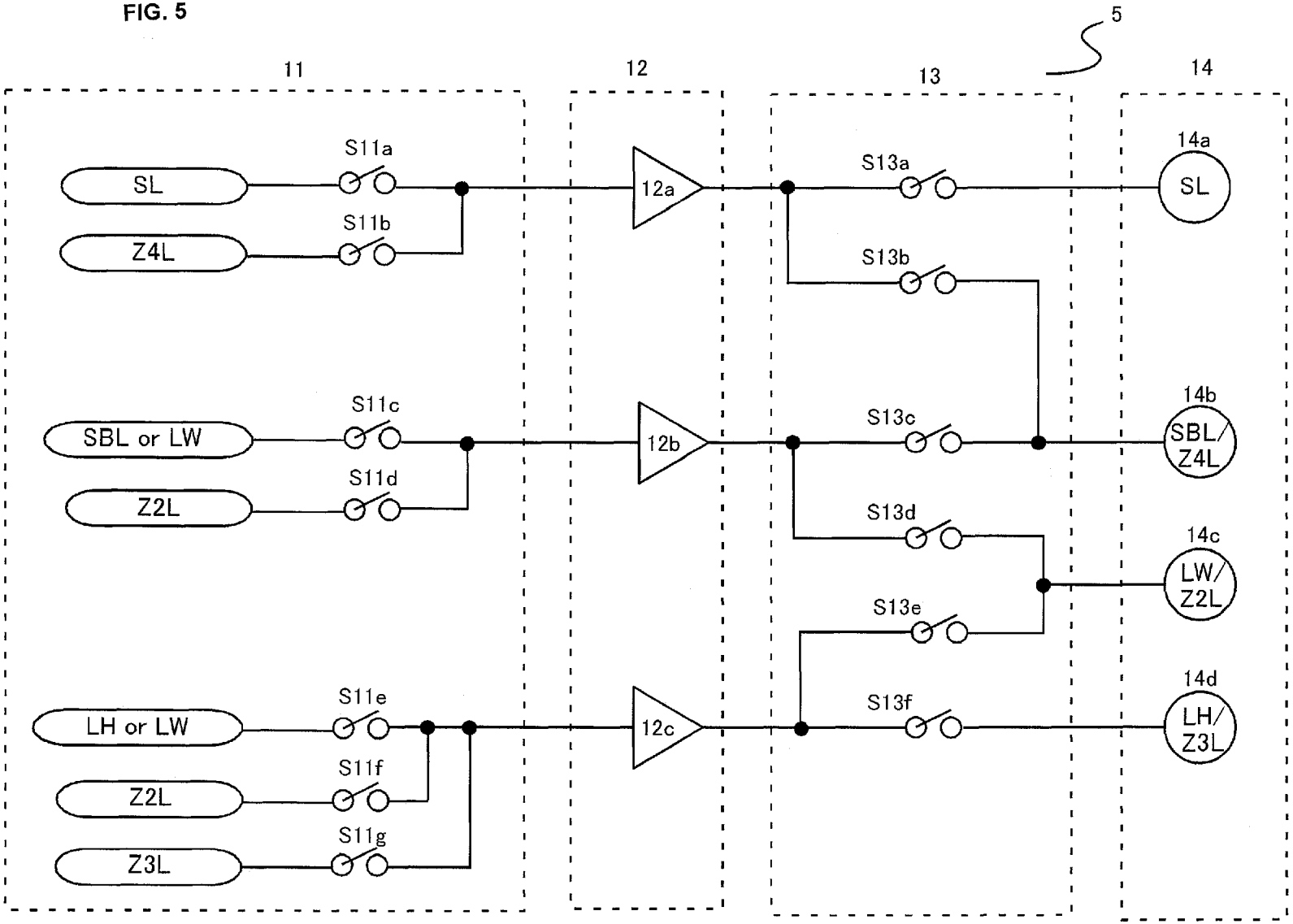
FIG. 5 is a view illustrating an audio processing unit.
Figure 6:
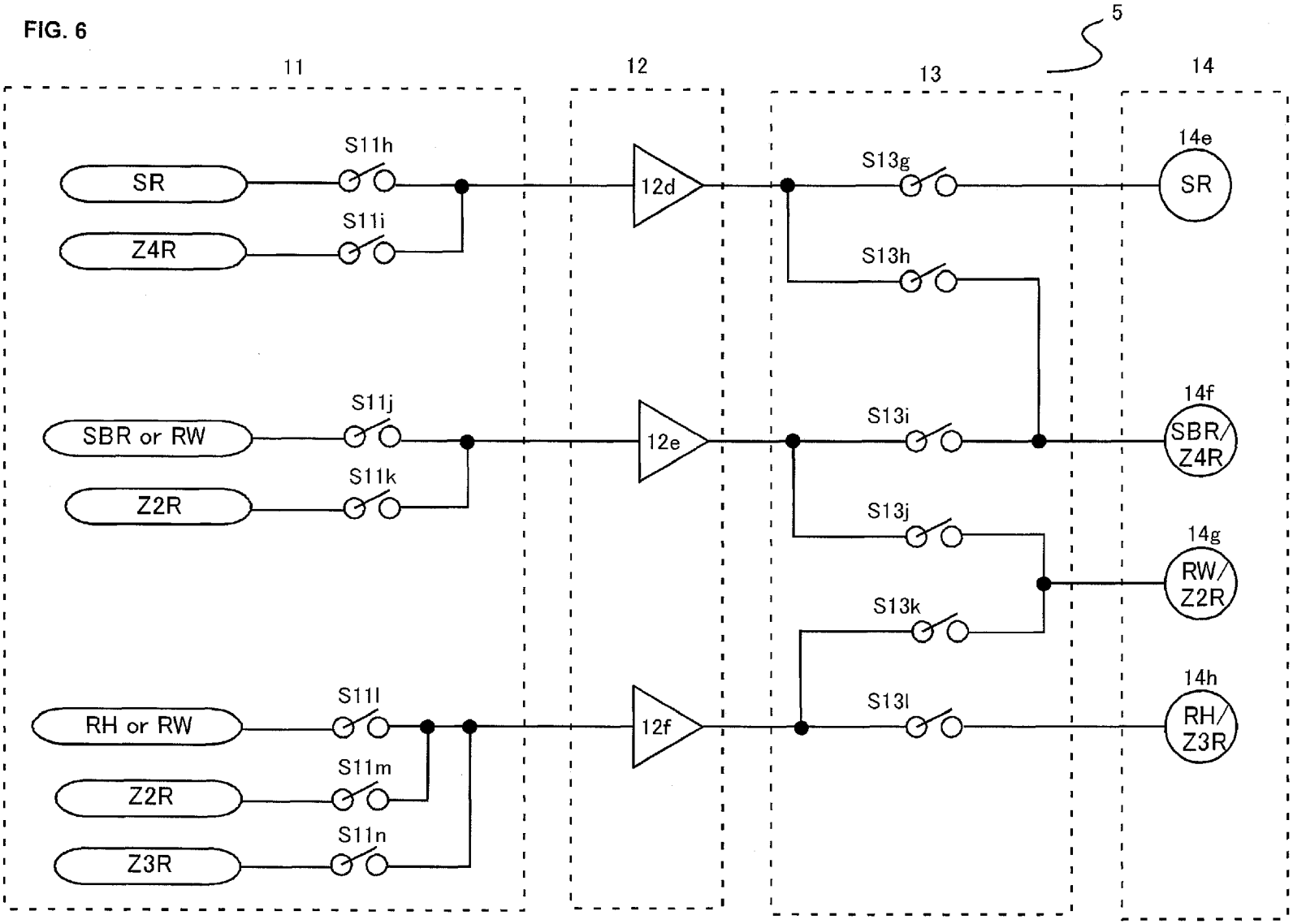
FIG. 6 is a view illustrating the audio processing unit.

FIGS. 5 and 6 are block diagrams illustrating a main part of the audio processing unit 5. FIG. 5 illustrates a configuration related to a left channel, and FIG. 6 illustrates a configuration related to a right channel. The audio processing unit 5 includes a front-stage SP (speaker) relay 11, a power amplifier 12, a latter-stage SP (speaker) relay 13, and an SP (speaker) terminal 14. In FIGS. 5 and 6, because circuits related to 3.1 channels (the left audio signal L, the right audio signal R, the central audio signal C, and the low-frequency audio signal SW) in basic 5.1 channels are identical to those of the related art, the circuits are omitted. A DSP and the like provided at a front-stage of the front-stage SP relay 11 are also omitted.

The DSP decodes the multichannel audio data supplied from the HDMI receiver 3, and generates the audio data of each channel. The generated audio data is supplied to the front-stage SP relay 11.

The front-stage SP relay 11 includes switches S11*a* to S11*g*. On-off control is performed to each switch in response to an instruction from the controller 2.

The switch S11*a* switches whether the surround left audio signal SL input from the DSP is supplied to an amplifier 12*a*. The switch S11*b* switches whether the ZONE4 left audio signal Z4L supplied from the DSP is supplied to the amplifier 12*a*. The switch S11*c* switches whether the surround back left audio signal SBL or the left outside audio signal LW, which is input from the DSP, is supplied to an amplifier 12*b*. The switch S11*d* switches whether the ZONE2 left audio signal Z2L supplied from the DSP is supplied to the amplifier 12*b*. The switch S11*d* switches whether the left upside audio signal LH or the left outside audio signal LW, which is input from the DSP, is supplied to an amplifier 12*c*. The switch S11*f* switches whether the ZONE2 left audio signal Z2L supplied from the DSP is supplied to the amplifier 12*c*. The switch S11*g* switches whether the ZONE3 left audio signal Z3L supplied from the DSP is supplied to the amplifier 12*c*.

The switch S11*h* switches whether the surround right audio signal SR input from the DSP is supplied to an amplifier 12*d*. The switch S11*i* switches whether the ZONE4 right audio signal Z4R supplied from the DSP is supplied to the amplifier 12*d*. The switch S11*j* switches whether the surround back right audio signal SBR or the right outside audio signal RW, which is input from the DSP, is supplied to an amplifier 12*e*. The switch S11*k* switches whether the ZONE2 right audio signal Z2R supplied from the DSP is supplied to the amplifier 12*e*. The switch S111 switches whether the right upside audio signal RH or the right outside audio signal RW, which is input from the DSP, is supplied to an amplifier 12*f*. The switch S11*m* switches whether the ZONE2 right audio signal Z2R supplied from the DSP is supplied to the amplifier 12*f*. The switch S11*n* switches whether the ZONE3 right audio signal Z3R supplied from the DSP is supplied to the amplifier 12*f*.

The power amplifier 12 includes amplifiers 12*a* to 12*f*. The amplifier 12*a* amplifies the surround left audio signal SL supplied from the switch S11*a*, and supplies the surround left audio signal SL to the latter-stage SP relay 13 (a switch 513*a*). Alternatively, the amplifier 12*a* amplifies the ZONE4 left audio signal Z4L supplied from the switch S11*b*, and supplies the ZONE4 left audio signal Z4L to the latter-stage SP relay 13 (a switch S13*b*). The amplifier 12*b* amplifies the surround back left audio signal SBL supplied from the switch S11*c*, and supplies the surround back left audio signal SBL to the latter-stage SP relay 13 (a switch S13*c*). Alternatively, the amplifier 12*b* amplifies the left outside audio signal LW supplied from the switch S11*c*, and supplies the left outside audio signal LW to the latter-stage SP relay 13 (a switch S13*d*). Alternatively, the amplifier 12*b* amplifies the ZONE2 left audio signal Z2L supplied from the switch S11*d*, and supplies the ZONE2 left audio signal Z2L to the latter-stage SP relay 13 (a switch S13*d*). The amplifier 12*c* amplifies the left upside audio signal LH supplied from the switch S11*e*, and supplies the left upside audio signal LH to the latter-stage SP relay 13 (a switch 513*f*). Alternatively, the amplifier 12*c* amplifies the left outside audio signal LW supplied from the switch S11*e*, and supplies the left outside audio signal LW to the latter-stage SP relay 13 (a switch S13*e*). Alternatively, the amplifier 12*c* amplifies the ZONE2 left audio signal Z2L supplied from the switch S11*f*, and supplies the ZONE2 left audio signal Z2L to the latter-stage SP relay 13 (a switch 513*e*). Alternatively, the amplifier 12*c* amplifies the ZONE3 left audio signal Z3L supplied from the switch 511*g*, and supplies the ZONE3 left audio signal Z3L to the latter-stage SP relay 13 (a switch S13*f*).

The amplifier 12*d* amplifies the surround right audio signal SR supplied from the switch S11*h*, and supplies the surround right audio signal SR to the latter-stage SP relay 13 (a switch 513*g*). Alternatively, the amplifier 12*d* amplifies the ZONE4 right audio signal Z4R supplied from the switch S11*i*, and supplies the ZONE4 right audio signal Z4R to the latter-stage SP relay 13 (a switch S13*h*). The amplifier 12*e* amplifies the surround back right audio signal SBR supplied from the switch S11*j*, and supplies the surround back right audio signal SBR to the latter-stage SP relay 13 (a switch S13*i*). Alternatively, the amplifier 12*e* amplifies the right outside audio signal RW supplied from the switch S11*j*, and supplies the right outside audio signal RW to the latter-stage SP relay 13 (a switch S13*j*). Alternatively, the amplifier 12*e* amplifies the ZONE2 right audio signal Z2R supplied from the switch S11*k*, and supplies the ZONE2 right audio signal Z2R to the latter-stage SP relay 13 (a switch S13*j*). The amplifier 12*f* amplifies the right upside audio signal RH supplied from the switch S111, and supplies the right upside audio signal RH to the latter-stage SP relay 13 (a switch S131). Alternatively, the amplifier 12*f* amplifies the right outside audio signal RW supplied from the switch S111, and supplies the right outside audio signal RW to the latter-stage SP relay 13 (a switch S13*k*). Alternatively, the amplifier 12*f* amplifies the ZONE2 right audio signal Z2R supplied from the switch S11*m*, and supplies the ZONE2 right audio signal Z2R to the latter-stage SP relay 13 (a switch S13*k*). Alternatively, the amplifier 12*f* amplifies the ZONE3 right audio signal Z3R supplied from the switch S11*n*, and supplies the ZONE3 right audio signal Z3R to the latter-stage SP relay 13 (a switch S131).

The latter-stage SP relay 13 includes relay switches (hereinafter referred to as switches) 513*a* to S131. The on-off control is performed to each switch in response to the instruction from the controller 2.

The switch 513*a* switches whether the surround left audio signal SL supplied from the amplifier 12*a* is supplied to a surround left SP terminal 14*a*. The switch S13*b* switches whether the ZONE4 left audio signal Z4L supplied from the amplifier 12*a* is supplied to a surround back left/ZONE4 left SP terminal 14*b*. The switch S13*c* switches whether the surround back left audio signal SBL supplied from the amplifier 12*b* is supplied to the surround back left/ZONE4 left SP terminal 14*b*. The switch S13*d* switches whether the left outside audio signal LW or the ZONE2 left audio signal Z2L, which is supplied from the amplifier 12*b*, is supplied to a left outside/ZONE2 left SP terminal 14*c*. The switch 513*e* switches whether the left outside audio signal LW or the ZONE2 left audio signal Z2L, which is supplied from the amplifier 12*c*, is supplied to the left outside/ZONE2 left SP terminal 14*c*. The switch S13*f* switches whether the left upside audio signal LH or the ZONE3 left audio signal Z3L, which is supplied from the amplifier 12*c*, is supplied to a left upside/ZONE3 left SP terminal 14*d*.

The switch S13*g* switches whether the surround right audio signal SR supplied from the amplifier 12*d* is supplied to a surround right SP terminal 14*e*. The switch S13*h* switches whether the ZONE4 right audio signal Z4R supplied from the amplifier 12*d* is supplied to a surround back right/ZONE4 right SP terminal 14*f*. The switch S13*i* switches whether the surround back right audio signal SBR supplied from the amplifier 12*e* is supplied to the surround back right/ZONE4 right SP terminal 14*f*. The switch S13*j* switches whether the right outside audio signal RW or the ZONE2 right audio signal Z2R, which is supplied from the amplifier 12*e*, is supplied to a right outside/ZONE2 right SP terminal 14*g*. The switch S13*k* switches whether the right outside audio signal RW or the ZONE2 right audio signal Z2R, which is supplied from the amplifier 12*f*, is supplied to the right outside/ZONE2 right SP terminal 14*g*. The switch S131 switches whether the right upside audio signal RH or the ZONE3 right audio signal Z3R, which is supplied from the amplifier 12*f*, is supplied to a right upside/ZONE3 right SP terminal 14*h*.

The SP terminal 14 includes the SP terminals 14*a* to 14*h*. The surround left speaker SSL is connected to the surround left SP terminal 14*a*. The surround back left speaker SSBL or the ZONE4 left speaker SZ4L is connected to the surround back left/ZONE4 left SP terminal 14*b*. The left outside speaker SLW or the ZONE2 left speaker SZ2L is connected to the left outside/ZONE2 left SP terminal 14*c*. The left upside speaker SLH or the ZONE3 left speaker SZ3L is connected to the left upside/ZONE3 left SP terminal 14*d*.

The surround right speaker SSR is connected to the surround right SP terminal 14*e*. The surround back right speaker SSBR or the ZONE4 right speaker SZ4R is connected to the surround back right/ZONE4 right SP terminal 14*f*. The right outside speaker SRW or the ZONE2 right speaker SZ2R is connected to the right outside/ZONE2 right SP terminal 14*g*. The right upside speaker SRH or the ZONE3 right speaker SZ3R is connected to the right upside/ZONE3 right SP terminal 14*h*.

Referring to FIG. 3, the HDMI transmitter 4 converts the video data supplied from the HDMI receiver 3 into the HDMI data, and transmits the HDMI data to the display device 200.

The controller 2 controls each unit based on an operating program of the AV amplifier, which is stored in a built-in or connected memory (not illustrated). For example, the controller 2 is a microcomputer or a CPU and the like. The controller 2 determines the channel included in the multichannel audio data (that is, the channel to be played back) or a ZONE output setting by a user manipulation, controls the audio signal supplied from the DSP to the switch, and performs the switching control of each switch. The multichannel audio data is not limited to the audio data received from the BD player 100, but the multichannel audio data maybe the audio data that is generated and output by the DSP.

The HDMI receiver 3 generates the original multichannel audio data from the HDMI data, and supplies the original multichannel audio data to the audio processing unit 5. The audio processing unit 5 decodes the multichannel audio data, reads channel information included in an information domain of the multichannel audio data, and supplies the channel information to the controller 2.

An operation of the first embodiment will be described below.

(In the Case that Surround Left Audio Signal SL and Surround Right Audio Signal SR are Played Back)

When determining that the multichannel audio data includes the surround left audio signal SL, the controller 2 controls the switches S11*a* and S13*a* in the on state, and controls the switches S11*b* and S13*b* in the off state. Accordingly, the surround left audio signal SL is supplied from the DSP to the amplifier 12*a* through the switch S11*a*, amplified by the amplifier 12*a*, and supplied to the surround left SP terminal 14*a* through the switch S13*a*.

When determining that the multichannel audio data includes the surround right audio signal SR, the controller 2 controls the switches S11*h* and S13*g* in the on state, and controls the switches S11*i* and S13*h* in the off state. Accordingly, the surround right audio signal SR is supplied from the DSP to the amplifier 12*d* through the switch S11*h*, amplified by the amplifier 12*d*, and supplied to the surround right SP terminal 14*e* through the switch S13*g*.

(In the Case that Surround Back Left Audio Signal SBL and Surround Back Right Audio Signal SBR are Played Back)

When determining that the multichannel audio data includes the surround back left audio signal SBL, the controller 2 controls the switches S11*c* and S13*c* in the on state, and controls the switches S11*d*, S13*b*, and S13*d* in the off state. Accordingly, the surround back left audio signal SBL is supplied from the DSP to the amplifier 12*b* through the switch S11*c*, amplified by the amplifier 12*b*, and supplied to the surround back left/ZONE4 left SP terminal 14*b* through the switch S13*c*.

When determining that the multichannel audio data includes the surround back right audio signal SBR, the controller 2 controls the switches S11*j* and S13*i* in the on state, and controls the switches S11*k*, 513*h*, and S13*j* in the off state. Accordingly, the surround back right audio signal SBR is supplied from the DSP to the amplifier 12*e* through the switch S11*j*, amplified by the amplifier 12*e*, and supplied to the surround back right/ZONE4 right SP terminal 14*f* through the switch S13*i*.

(In the Case that Left Upside Audio Signal LH and Right Upside Audio Signal RH are Played Back)

When determining that the multichannel audio data includes the left upside audio signal LH, the controller 2 controls the switches S11*e* and S13*f* in the on state, and controls the switches S11*f*, S11*g*, and S13*e* in the off state. Accordingly, the left upside audio signal LH is supplied from the DSP to the amplifier 12*c* through the switch S11*e*, amplified by the amplifier 12*c*, and supplied to the left upside/ZONE3 left SP terminal 14*d* through the switch S13*f*.

When determining that the multichannel audio data includes the right upside audio signal RH, the controller 2 controls the switches S111 and S131 in the on state, and controls the switches S11*m*, S11*n*, and S13*k* in the off state. Accordingly, the right upside audio signal RH is supplied from the DSP to the amplifier 12*f* through the switch S111, amplified by the amplifier 12*f*, and supplied to the right upside/ZONE3 right SP terminal 14*h* through the switch S131.

(In the Case Left Outside Audio Signal LW and Right Outside Audio Signal RW are Played Back (1))

When determining that the multichannel audio data includes the left outside audio signal LW, the controller 2 controls the switches S11*c* and S13*d* in the on state, and controls the switches S11*d*, S13*c*, and 13*e* in the off state. Accordingly, the left outside audio signal LW is supplied from the DSP to the amplifier 12*b* through the switch S11*c*, amplified by the amplifier 12*b*, and supplied to the left outside/ZONE2 left SP terminal 14*c* through the switch S13*d*.

When determining that the multichannel audio data includes the right outside audio signal RW, the controller 2 controls the switches S11*j* and S13*j* in the on state, and controls the switches S11*k*, S13*i*, and S13*k* in the off state. Accordingly, the right outside audio signal RW is supplied from the DSP to the amplifier 12*e* through the switch S11*j*, amplified by the amplifier 12*e*, and supplied to the right outside/ZONE2 right SP terminal 14*g* through the switch S13*j*.

In this case, one of the left upside audio signal LH and the ZONE3 left audio signal Z3L can be played back while the left outside audio signal LW is played back. Additionally the ZONE4 left audio signal Z4L can be played back while the left outside audio signal LW is played back. Similarly one of the right upside audio signal RH and the ZONE3 right audio signal Z3R can be played back while the right outside audio signal RW is played back. Additionally the ZONE4 right audio signal Z4R can be played back while the right outside audio signal RW is played back.

(In the Case that Left Outside Audio Signal LW and Right Outside Audio Signal RW are Played Back (2))

When determining that the multichannel audio data includes the left outside audio signal LW, the controller 2 controls the switches S11*e* and S13*e* in the on state, and controls the switches S11*f*, S11*g*, S13*d*, and 13*f* in the off state. Accordingly, the left outside audio signal LW is supplied from the DSP to the amplifier 12*c* through the switch S11*e*, amplified by the amplifier 12*c*, and supplied to the left outside/ZONE2 left SP terminal 14*c* through the switch S13*e*.

When determining that the multichannel audio data includes the right outside audio signal RW, the controller 2 controls the switches S111 and S13*k* in the on state, and controls the switches S11*m*, S11*n*, S13*j*, and 131 in the off state. Accordingly, the right outside audio signal RW is supplied from the DSP to the amplifier 12*f* through the switch S111, amplified by the amplifier 12*f*, and supplied to the right outside/ZONE2 right SP terminal 14*g* through the switch S13*k*.

In this case, one of the surround back left audio signal SBL and the ZONE4 left audio signal Z4L can be played back while the left outside audio signal LW is played back. Similarly one of the surround back right audio signal SBR and the ZONE4 right audio signal Z4R can be played back while the right outside audio signal RW is played back.

(In the Case that ZONE4 Left Audio Signal Z4L and ZONE4 Right Audio Signal Z4R are Played Back)

When determining that the playback of the ZONE4 left audio signal Z4L is set by the user manipulation, the controller 2 controls the switches S11*b* and S13*b* in the on state, and controls the switches S11*a*, 513*a*, and S13*c* in the off state. Accordingly, the ZONE4 left audio signal Z4L is supplied from the DSP to the amplifier 12*a* through the switch S11*b*, amplified by the amplifier 12*a*, and supplied to the surround back left/ZONE4 left SP terminal 14*b* through the switch S13*b*.

When determining that the playback of the ZONE4 right audio signal Z4R is set by the user manipulation, the controller 2 controls the switches S11*i* and 513*h* in the on state, and controls the switches S11*h*, 513*g*, and S13*i* in the off state. Accordingly, the ZONE4 right audio signal Z4R is supplied from the DSP to the amplifier 12*d* through the switch S11*i*, amplified by the amplifier 12*d*, and supplied to the surround back right/ZONE4 right SP terminal 14*f* through the switch S13*h*.

As described above, although the ZONE4 left audio signal Z4L and the surround left audio signal SL cannot simultaneously be played back, the ZONE4 left audio signal Z4L is output from not the surround left SP terminal 14*a* but the surround back left/ZONE4 left SP terminal 14*b*. That is, the surround left SP terminal 14*a* is the dedicated speaker terminal for playing back the surround left audio signal SL. Accordingly, in order to playback the ZONE4 left audio signal Z4L, it is not necessary to release the connection of the surround left speaker SSL having the high use frequency. Similarly, although the ZONE4 right audio signal Z4R and the surround right audio signal SR cannot simultaneously be played back, the ZONE4 right audio signal Z4R is output from not the surround right SP terminal 14*e* but the surround back right/ZONE4 right SP terminal 14*f*. That is, the surround right SP terminal 14*e* is the dedicated speaker terminal for playing back the surround right audio signal SR. Accordingly, in order to play back the ZONE4 right audio signal Z4R, it is not necessary to release the connection of the surround right speaker SSR having the high use frequency.

The ZONE2 left audio signal Z2L (or the left outside audio signal LW) and the ZONE3 left audio signal Z3L (or the left upside audio signal LH) can be played back while the ZONE4 left audio signal Z4L is played back. Similarly the ZONE2 right audio signal Z2R (or the right outside audio signal RW) and the ZONE3 right audio signal Z3R (or the right upside audio signal RH) can be played back while the ZONE4 right audio signal Z4R is played back.

(In the Case that ZONE3 Left Audio Signal Z3L and ZONE3 Right Audio Signal Z3R are Played Back)

When determining that the playback of the ZONE3 left audio signal Z3L is set by the user manipulation, the controller 2 controls the switches S11*g* and S13*f* in the on state, and controls the switches S11*e*, S11*f*, and S13*e* in the off state. Accordingly, the ZONE3 left audio signal Z3L is supplied from the DSP to the amplifier 12*c* through the switch S11*g*, amplified by the amplifier 12*c*, and supplied to the left upside/ZONE3 left SP terminal 14*d* through the switch 513*f*.

When determining that the playback of the ZONE3 right audio signal Z3R is set by the user manipulation, the controller 2 controls the switches S11*n* and S131 in the on state, and controls the switches S111, S11*m*, and S13*k* in the off state. Accordingly, the ZONE3 right audio signal Z3R is supplied from the DSP to the amplifier 12*f* through the switch S11*n*, amplified by the amplifier 12*f*, and supplied to the right upside/ZONE3 right SP terminal 14*h* through the switch S131.

The ZONE2 left audio signal Z2L (or the left outside audio signal LW or the surround back left audio signal SBL) can be played back while the ZONE3 left audio signal Z3L is played back. The ZONE4 left audio signal Z4L (or the surround left audio signal SL) can be played back while the ZONE3 left audio signal Z3L is played back. Similarly the ZONE2 right audio signal Z2R (or the right outside audio signal RW or the surround back right audio signal BR) can be played back while the ZONE3 right audio signal Z3R is played back. The ZONE4 right audio signal Z4R (or the surround right audio signal SR) can be played back while the ZONE3 right audio signal Z3R is played back.

(In the Case that the ZONE2 Left Audio Signal Z2L and the ZONE2 Right Audio Signal Z2R are Played Back (1))

When determining that the playback of the ZONE2 left audio signal Z2L is set by the user manipulation, the controller 2 controls the switches S11*d* and S13*d* in the on state, and controls the switches S11*c*, S13*c*, and S13*e* in the off state. Accordingly, the ZONE2 left audio signal Z2L is supplied from the DSP to the amplifier 12*b* through the switch S11*d*, amplified by the amplifier 12*b*, and supplied to the left outside/ZONE2 left SP terminal 14*c* through the switch S13*d*.

When determining that the playback of the ZONE2 right audio signal Z2R is set by the user manipulation, the controller 2 controls the switches S11*k* and S13*j* in the on state, and controls the switches S11*j*, S13*i*, and S13*k* in the off state. Accordingly, the ZONE2 right audio signal Z2R is supplied from the DSP to the amplifier 12*e* through the switch S11*k*, amplified by the amplifier 12*e*, and supplied to the right outside/ZONE2 right SP terminal 14*g* through the switch S13*j*.

In this case, one of the left upside audio signal LH and the ZONE3 left audio signal Z3L can be played back while the ZONE2 left audio signal Z2L is played back. Additionally one of the ZONE4 left audio signal Z4L and the surround left audio signal SL can be played back while the ZONE2 left audio signal Z2L is played back. Similarly one of the right upside audio signal RH and the ZONE3 right audio signal Z3R can be played back while the ZONE2 right audio signal Z2R is played back. Additionally one of the ZONE4 right audio signal Z4R and the surround right audio signal SR can be played back while the ZONE2 right audio signal Z2R is played back.

In the Case that ZONE2 Left Audio Signal Z2L and ZONE2 Right Audio Signal Z2R are Played Back (2))

When determining that the playback of the ZONE2 left audio signal Z2L is set by the user manipulation, the controller 2 controls the switches S11*f* and S13*e* in the on state, and controls the switches S11*e*, S11*g*, S13*d*, and S13*f* in the off state. Accordingly, the ZONE2 left audio signal Z2L is supplied from the DSP to the amplifier 12*c* through the switch S11*f*, amplified by the amplifier 12*c*, and supplied to the left outside/ZONE2 left SP terminal 14*c* through the switch S13*e*.

When determining that the playback of the ZONE2 right audio signal Z2R is set by the user manipulation, the controller 2 controls the switches S11*m* and S13*k* in the on state, and controls the switches S111, S11*n*, S13*j*, and S131 in the off state. Accordingly, the ZONE2 right audio signal Z2R is supplied from the DSP to the amplifier 12*f* through the switch S11*m*, amplified by the amplifier 12*f*, and supplied to the right outside/ZONE2 right SP terminal 14*g* through the switch S13*k*.

In this case, one of the surround left audio signal SL and the ZONE4 left audio signal Z4L can be played back while the ZONE2 left audio signal Z2L is played back. Similarly one of the surround right audio signal SR and the ZONE4 right audio signal Z4R can be played back while the ZONE2 right audio signal Z2R is played back.

Figure 7:
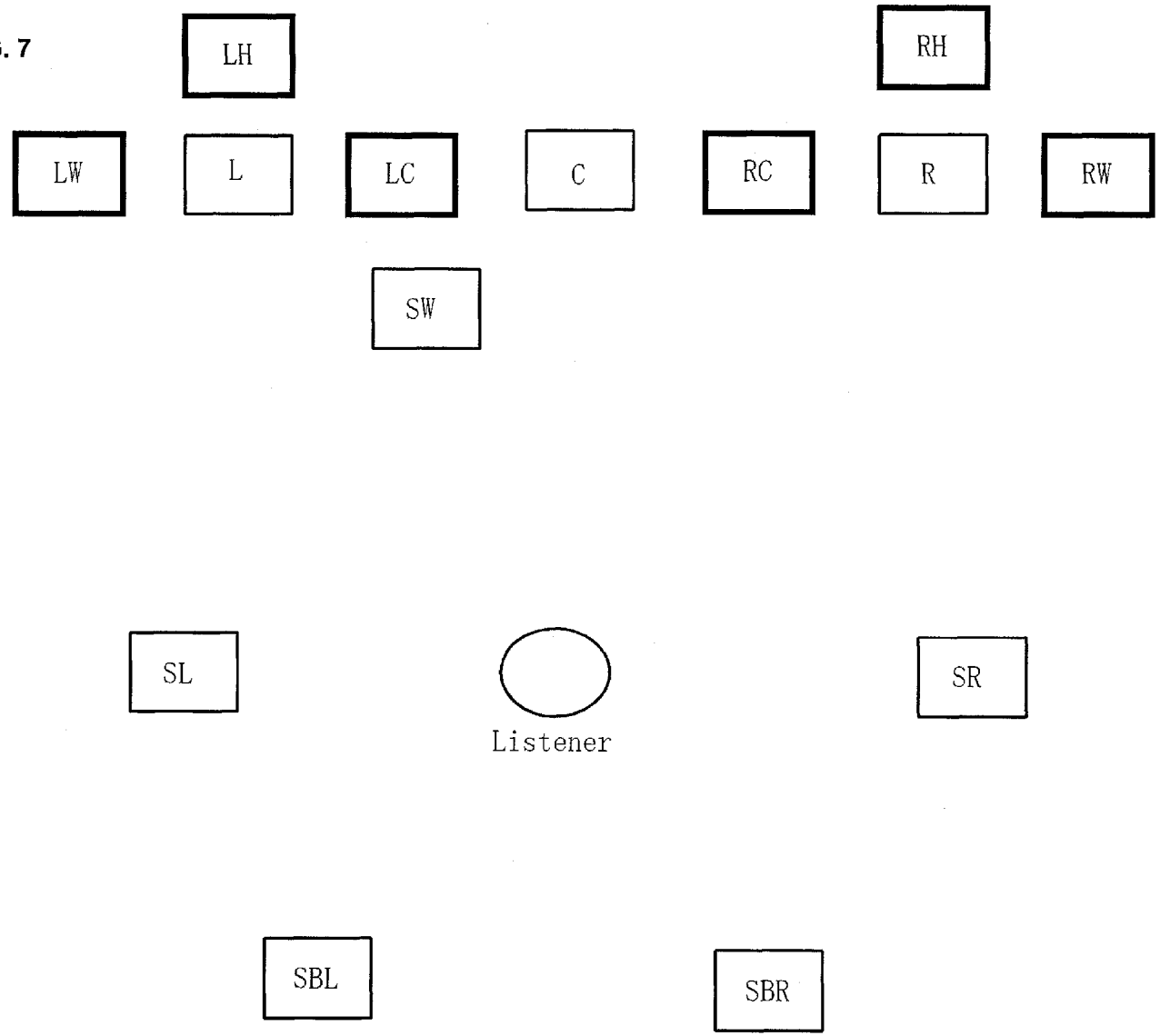
FIG. 7 is a view illustrating channels of audio signals.

A second embodiment of the present invention will be described below. As illustrated in FIG. 7, in the second embodiment, a left-central-side audio signal LC exists instead of (or in addition to) the left outside audio signal LW, and a right-central-side audio signal RC exists instead of (or in addition to) the right outside audio signal RW. The left-central-side audio signal LC is played back from a position between the left audio signal L and the central audio signal C. The right-central-side audio signal RC is played back from a position between the right audio signal R and the central audio signal C. In this case, as illustrated in FIG. 8, a circuit configuration in which the left outside audio signal LW is replaced with the left-central-side audio signal LC while the right outside audio signal RW is replaced with the right-central-side audio signal RC may be used.

Figure 8:
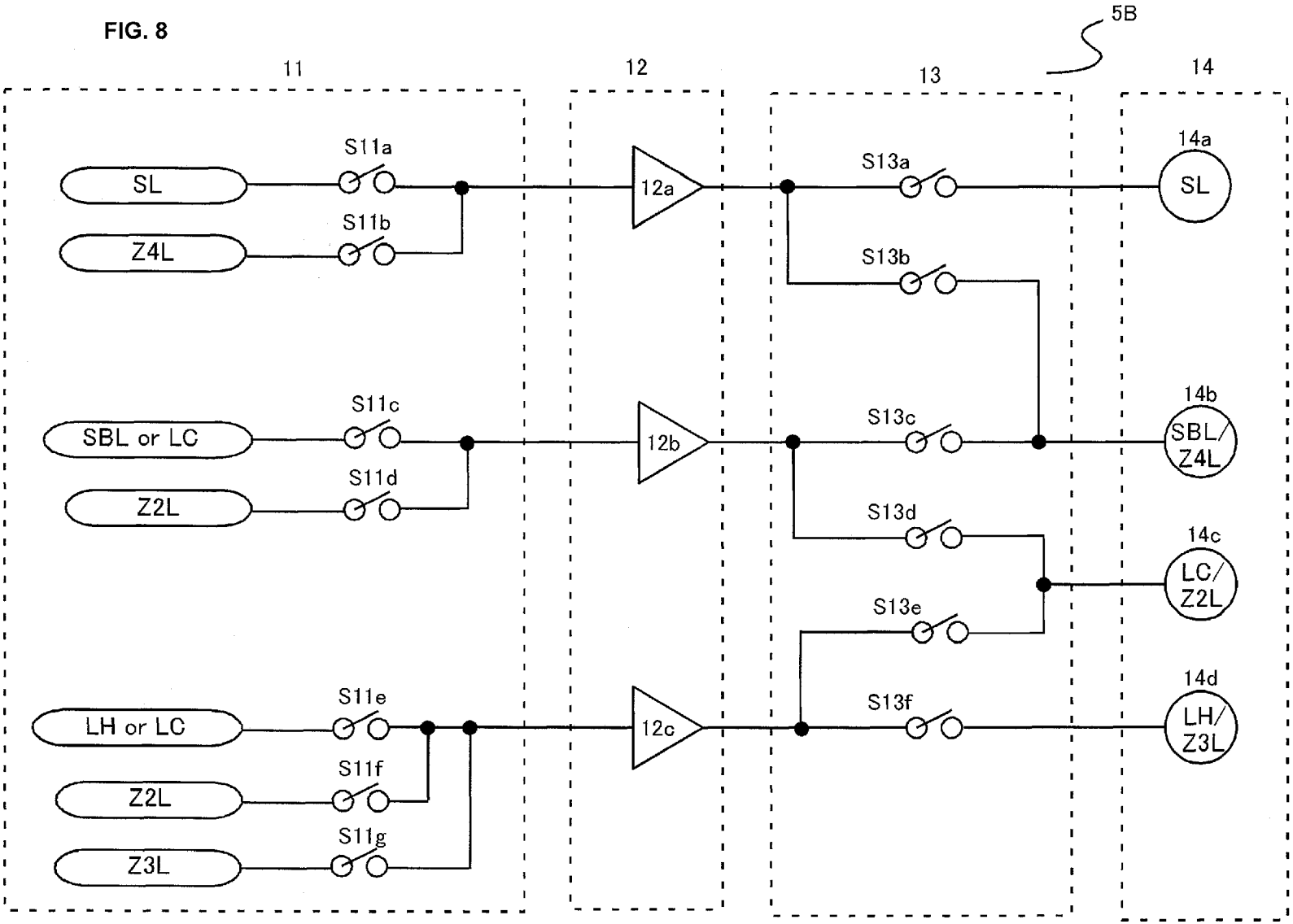
FIG. 8 is a view illustrating the audio processing unit.

When the second embodiment is generally expressed in consideration of the circuit configuration in FIG. 8, the surround back left audio signal SBL is defined as a first extended left audio signal, the surround back right audio signal SBR is defined as a first extended right audio signal, the left outside audio signal LW is defined as a second extended left audio signal, the right outside audio signal RW is defined as a second extended right audio signal, the left upside audio signal LH is defined as a third extended left audio signal, and the right upside audio signal RH is defined as a third extended right audio signal.

The first extended left audio signal may be any one of the surround back left audio signal SBL, the left outside audio signal LW, the left upside audio signal LH, and the left-central-side audio signal LC. The second extended left audio signal may be any one of the surround back left audio signal SBL, the left outside audio signal LW, the left upside audio signal LH, and the left-central-side audio signal LC, and the channel of the second extended left audio signal may be different from that of the first extended left audio signal. The third extended left audio signal may be any one of the surround back left audio signal SBL, the left outside audio signal LW, the left upside audio signal LH, and the left-central-side audio signal LC, and the channel of the third extended left audio signal may be different from that of each of the first extended left audio signal and the second extended left audio signal.

Similarly the first extended right audio signal may be any one of the surround back right audio signal SBR, the right outside audio signal RW, the right upside audio signal RH, and the right-central-side audio signal RC. The second extended right audio signal may be any one of the surround back right audio signal SBR, the right outside audio signal RW, the right upside audio signal RH, and the right-central-side audio signal RC, and the channel of the second extended right audio signal may be different from that of the first extended right audio signal. The third extended right audio signal may be any one of the surround back right audio signal SBR, the right outside audio signal RW, the right upside audio signal RH, and the right-central-side audio signal RC, and the channel of the third extended right audio signal may be different from that of each of the first extended left audio signal and the second extended left audio signal.

Figure 9:
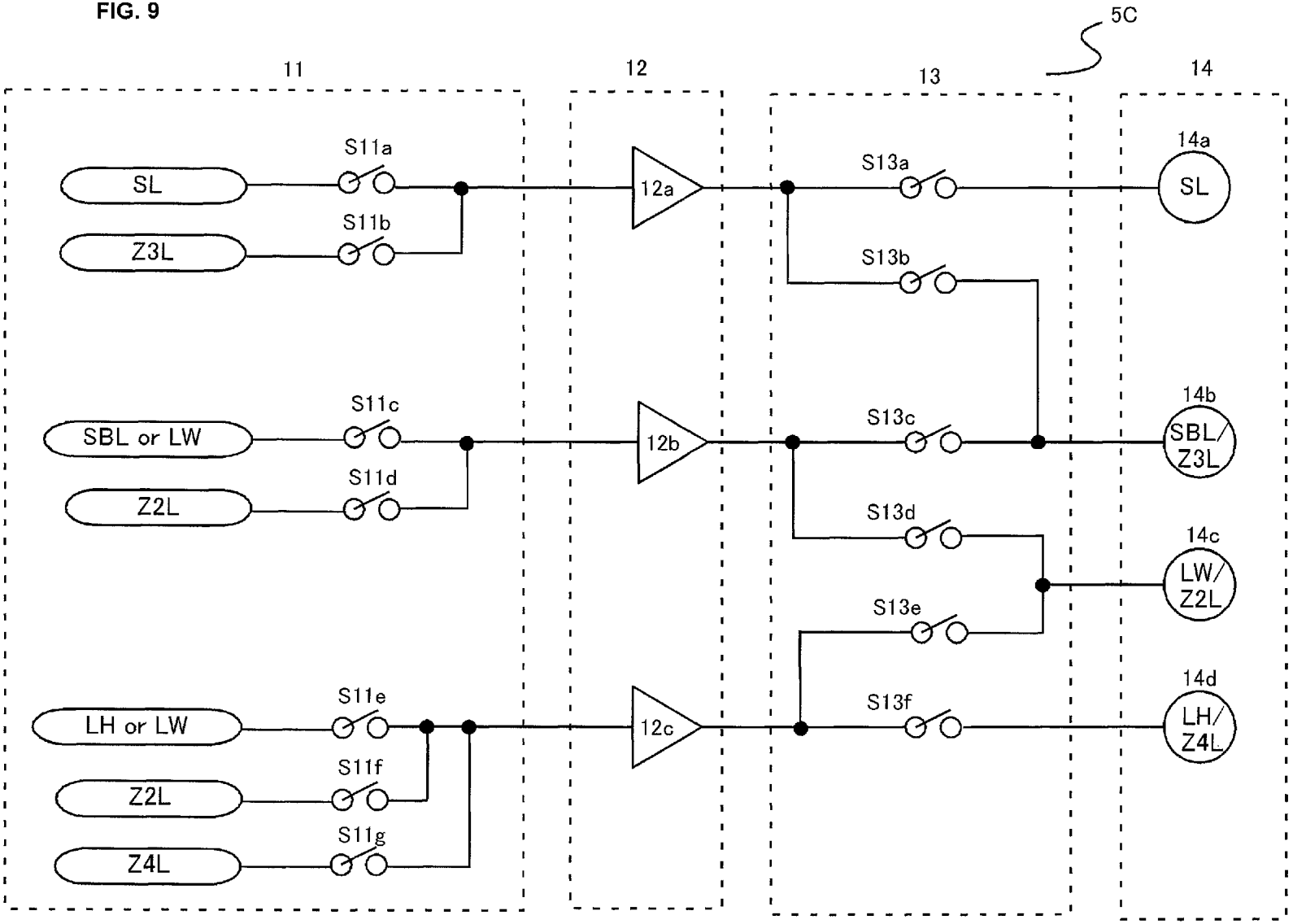
FIG. 9 is a view illustrating the audio processing unit.

As illustrated in FIG. 9, the ZONE3 left audio signal Z3L and the ZONE4 left audio signal Z4L may be exchanged for one another. That is, the numerical characters of ZONE2, ZONE3, and ZONE4 have no particular meaning, but the numerical characters are added for the sake of convenience. Therefore, it is noted that a modification or a change in which the numerical characters are exchanged for each other is included in the scope of the present invention.

Figure 10:
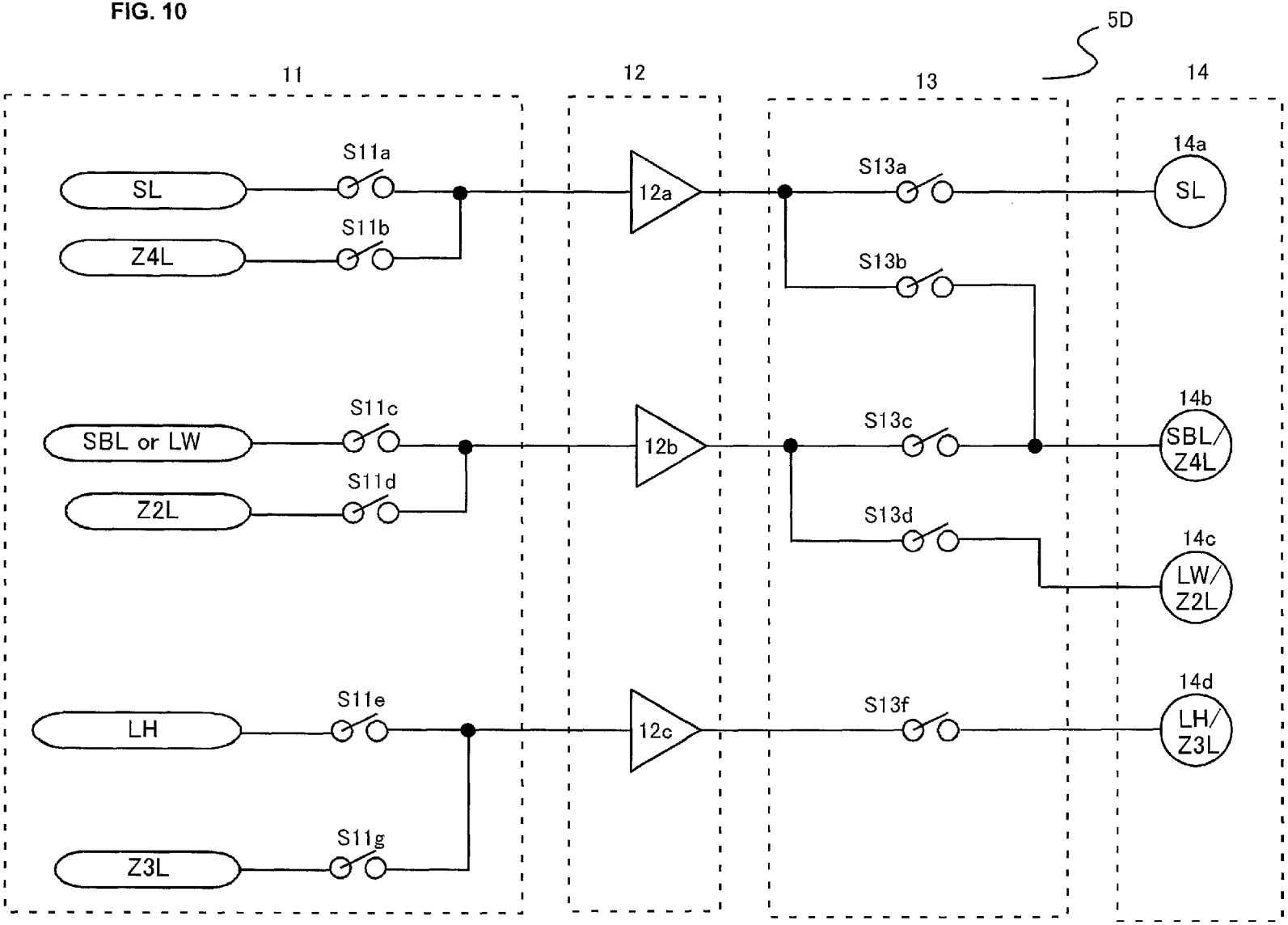
FIG. 10 is a view illustrating dispositions of the AV amplifier and the speakers.

As illustrated in FIG. 10, the switches S11*f* and S13*e* may be omitted in the configuration in FIG. 5. In this case, although the surround back left audio signal SBL and the left outside audio signal LW (or the ZONE2 left audio signal Z2L) cannot simultaneously be played back, advantageously it is not necessary to release the connection of the surround speaker SSL to the surround left SP terminal 14*a* in the case that the ZONE4 left audio signal Z4L is played back.

Figure 11:
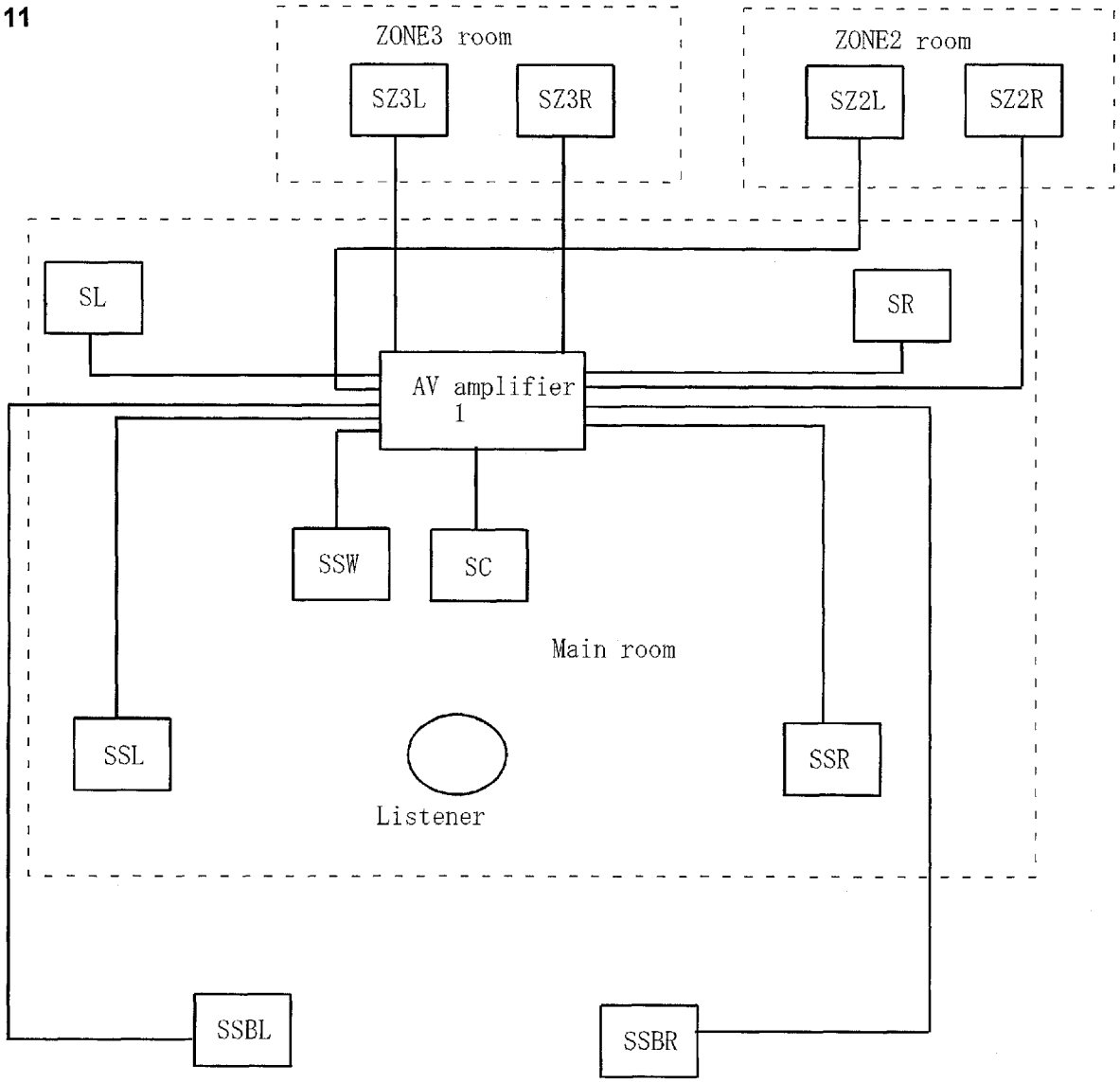
FIG. 11 is a view illustrating the audio processing unit.

A third embodiment of the present invention will be described below. FIG. 11 illustrates a state in which the ZONE2 left speaker SZ2L, the ZONE2 right speaker SZ2R, the ZONE3 left speaker SZ3L, and the ZONE3 right speaker SZ3R are connected instead of the left upside speaker SLH, the right upside speaker SRH, the left outside speaker SLW, and the right outside speaker SRW in FIG. 1.

Figure 12:
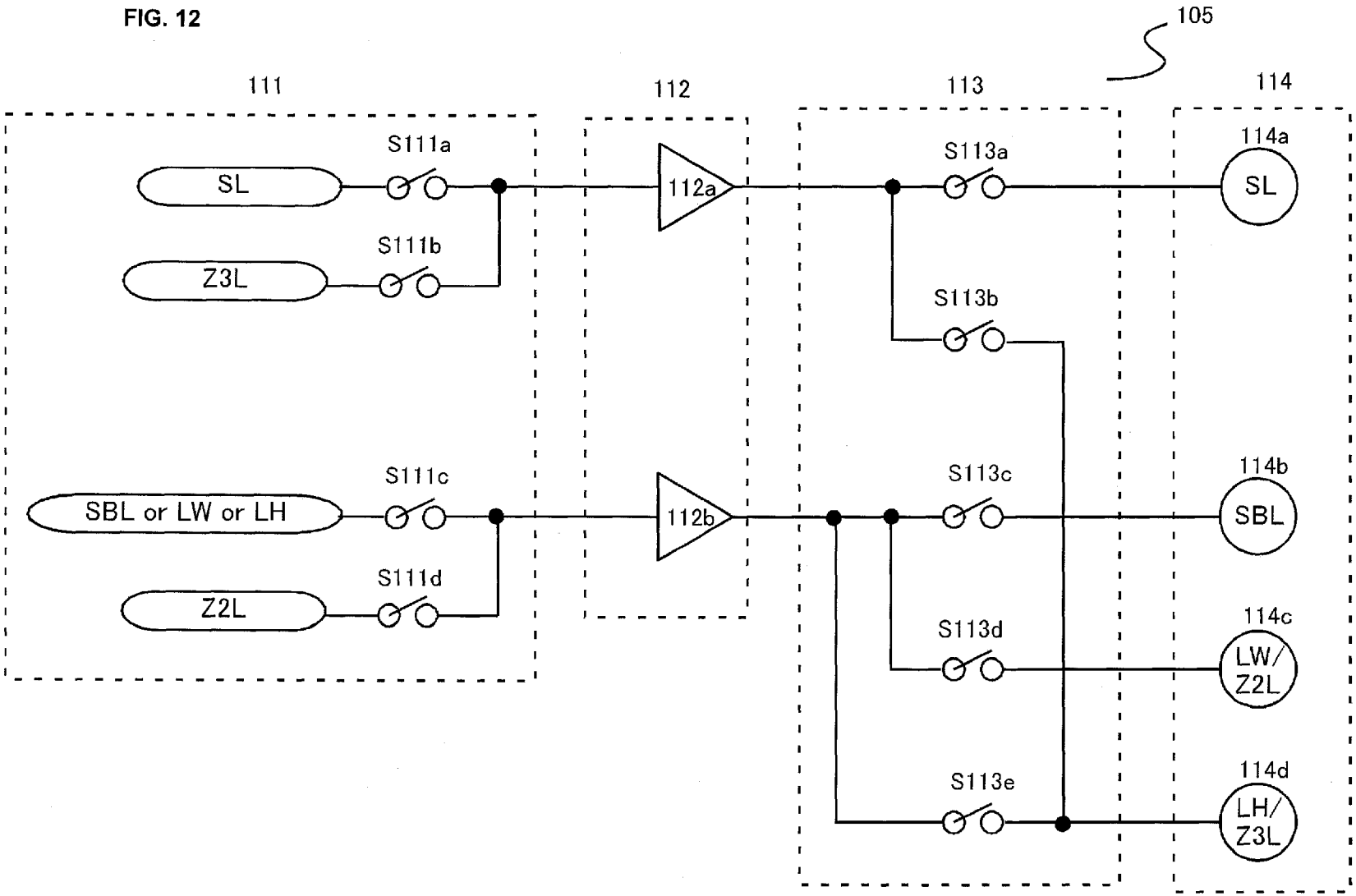
FIG. 12 is a view illustrating the audio processing unit.
Figure 13:
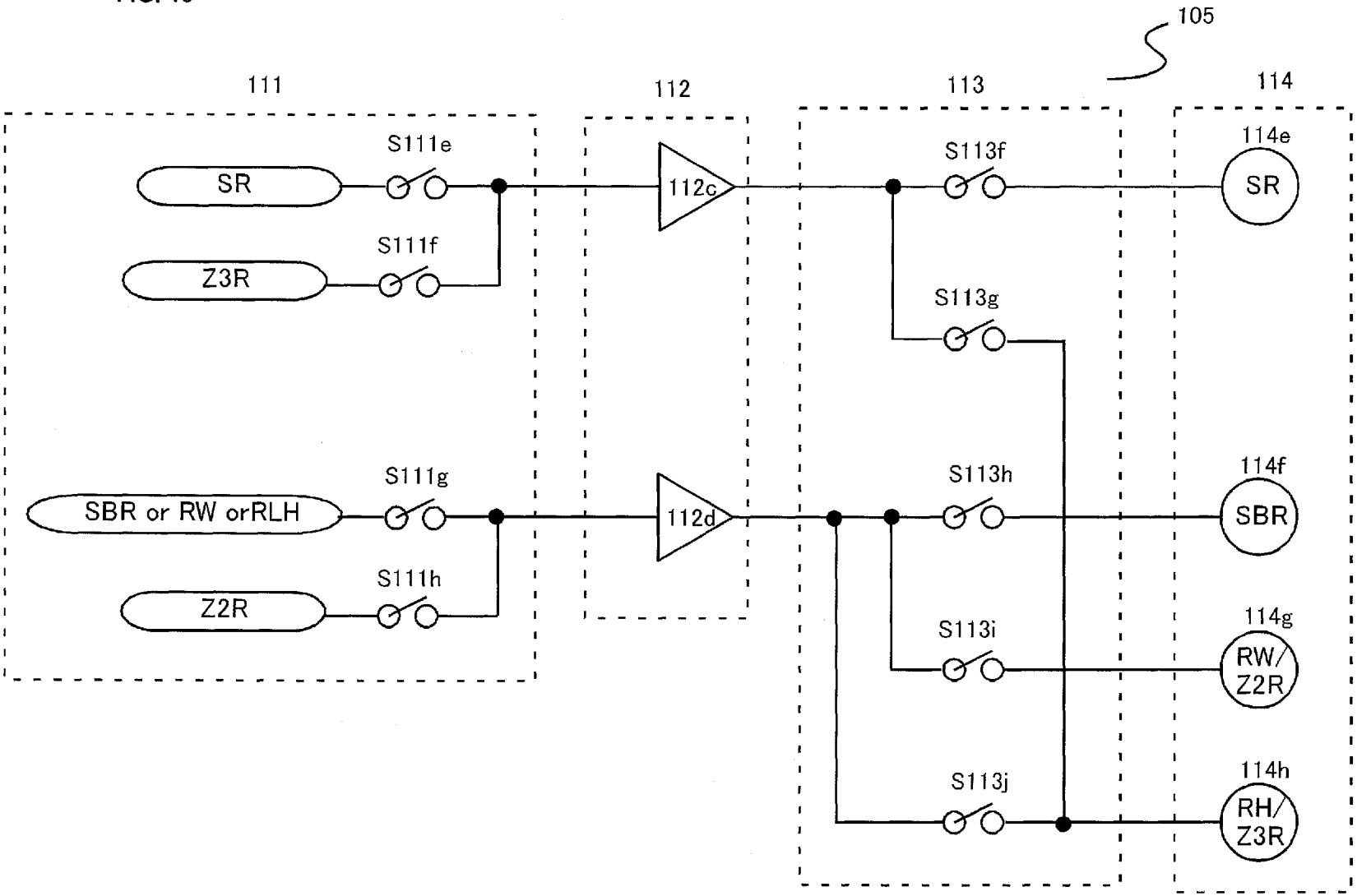
FIG. 13 is a view illustrating the audio processing unit.

FIGS. 12 and 13 are block diagrams illustrating a main part of an audio processing unit 105 of the third embodiment. FIG. 12 illustrates a configuration of the left channel, and FIG. 13 illustrates a configuration of the right channel. The audio processing unit 105 includes a front-stage SP (speaker) relay 111, a power amplifier 112, a latter-stage SP (speaker) relay 113, and a SP (speaker) terminal 114. In FIGS. 12 and 13, because the circuits related to the 3.1 channels (the left audio signal L, the right audio signal R, the central audio signal C, and the low-frequency audio signal SW) in the basic 5.1 channels are identical to those of the related art, the circuits are omitted. The DSP provided at the front-stage of the front-stage SP relay 111 is also omitted.

The DSP decodes the multichannel audio data supplied from the HDMI receiver 3, and generates the audio data of each channel. The generated audio data is supplied to the front-stage SP relay 111.

The front-stage SP relay 111 includes switches S111*a* to S111*h*. On-off control is performed to each switch in response to an instruction from the controller 2.

The switch S111*a* switches whether the surround left audio signal SL input from the DSP is supplied to an amplifier 112*a*. The switch S111*b* switches whether the ZONE3 left audio signal Z3L supplied from the DSP is supplied to the amplifier 112*a*. The switch S111*c* switches whether the surround back left audio signal SBL, the left outside audio signal LW or the left upside audio signal LH, which is input from the DSP, is supplied to an amplifier 112*b*. The switch S111*d* switches whether the ZONE2 left audio signal Z2L supplied from the DSP is supplied to the amplifier 112*b*.

The switch S111*e* switches whether the surround right audio signal SR input from the DSP is supplied to an amplifier 112*c*. The switch S111*f* switches whether the ZONE3 right audio signal Z3R supplied from the DSP is supplied to the amplifier 112*c*. The switch S111*g* switches whether the surround back right audio signal SBR, the right outside audio signal RW or the right upside audio signal RH, which is input from the DSP, is supplied to an amplifier 112*d*. The switch S111*h* switches whether the ZONE2 right audio signal Z2R supplied from the DSP is supplied to the amplifier 112*d*.

The power amplifier 112 includes the amplifiers 112*a* to 112*d*. The amplifier 112*a* amplifies the surround left audio signal SL supplied from the switch S111*a*, and supplies the surround left audio signal SL to the latter-stage SP relay 113 (a switch S113*a*). Alternatively, the amplifier 112*a* amplifies the ZONE3 left audio signal Z3L supplied from the switch S111*b*, and supplies the ZONE3 left audio signal Z3L to the latter-stage SP relay 113 (a switch S113*b*). The amplifier 112*b* amplifies the surround back left audio signal SBL supplied from the switch S111*c*, and supplies the surround back left audio signal SBL to the latter-stage SP relay 113 (a switch S113*c*). Alternatively, the amplifier 112*b* amplifies the left outside audio signal LW supplied from the switch S111*c* or the ZONE2 left audio signal Z2L supplied from the switch S111*d*, and supplies the left outside audio signal LW or the ZONE2 left audio signal Z2L to the latter-stage SP relay 113 (switch S113*d*). Alternatively, the amplifier 112*b* amplifies the left upside audio signal LH supplied from the switch S111*c*, and supplies the left upside audio signal LH to the latter-stage SP relay 113 (a switch S113*e*).

The amplifier 112*c* amplifies the surround right audio signal SR supplied from the switch S111*e*, and supplies the surround right audio signal SR to the latter-stage SP relay 113 (a switch S113*f*). Alternatively, the amplifier 112*c* amplifies the ZONE3 right audio signal Z3R supplied from the switch S111*f*, and supplies the ZONE3 right audio signal Z3R to the latter-stage SP relay 113 (a switch S113*g*). The amplifier 112*d* amplifies the surround back right audio signal SBR supplied from the switch S111*g*, and supplies the surround back right audio signal SBR to the latter-stage SP relay 113 (a switch S113*h*). Alternatively, the amplifier 112*d* amplifies the right outside audio signal RW supplied from the switch S111*g* or the ZONE2 right audio signal Z2R supplied from the switch S111*h*, and supplies the right outside audio signal RW or the ZONE2 right audio signal Z2R to the latter-stage SP relay 113 (a switch S113*i*). Alternatively, the amplifier 112*d* amplifies the right upside audio signal RH supplied from the switch S111*g*, and supplies the right upside audio signal RH to the latter-stage SP relay 113 (a switch S113*j*).

The latter-stage SP relay 113 includes relay switches (hereinafter referred to as switches) S113*a* to S113*j*. The on-off control is performed to each switch in response to the instruction from the controller 2.

The switch S113*a* switches whether the surround left audio signal SL supplied from the amplifier 112*a* is supplied to a surround left SP terminal 114*a*. The switch S113*b* switches whether the ZONE3 left audio signal Z3L supplied from the amplifier 112*a* is supplied to a left upside/ZONE3 left SP terminal 114*d*. The switch S113*c* switches whether the surround back left audio signal SBL supplied from the amplifier 112*b* is supplied to a surround back left SP terminal 114*b*. The switch S113*d* switches whether the left outside audio signal LW or the ZONE2 left audio signal Z2L, which is supplied from the amplifier 112*b*, is supplied to a left outside/ZONE2 left SP terminal 114*c*. The switch S113*e* switches whether the left upside audio signal LH supplied from the amplifier 112*b* is supplied to the left upside/ZONE3 left SP terminal 114*d*.

The switch S113*f* switches whether the surround right audio signal SR supplied from the amplifier 112*c* is supplied to a surround right SP terminal 114*e*. The switch S113*g* switches whether the ZONE3 right audio signal Z3R supplied from the amplifier 112*c* is supplied to a right upside/ZONE3 right SP terminal 114*h*. The switch S113*h* switches whether the surround back right audio signal SBR supplied from the amplifier 112*d* is supplied to a surround back right SP terminal 114*f*. The switch S113*i* switches whether the right outside audio signal RW or the ZONE2 right audio signal Z2R, which is supplied from the amplifier 112*d*, is supplied to a right outside/ZONE2 right SP terminal 114*g*. The switch S113*j* switches whether the right upside audio signal RH supplied from the amplifier 112*d* is supplied to the right upside/ZONE3 right SP terminal 114*h*.

The SP terminal 114 includes the SP terminals 114*a* to 114*h*. The surround left speaker SSL is connected to the surround left SP terminal 114*a*. The surround back left speaker SSBL is connected to the surround back left SP terminal 114*b*. The left outside speaker SLW or the ZONE2 left speaker SZ2L is connected to the left outside/ZONE2 left SP terminal 114*c*. The left upside speaker SLH or the ZONE3 left speaker SZ3L is connected to the left upside/ZONE3 left SP terminal 114*d*.

The surround right speaker SSR is connected to the surround right SP terminal 114*e*. The surround back right speaker SSBR is connected to the surround back right SP terminal 114*f*. The right outside speaker SRW or the ZONE2 right speaker SZ2R is connected to the right outside/ZONE2 right SP terminal 114*g*. The right upside speaker SRH or the ZONE3 right speaker SZ3R is connected to the right upside/ZONE3 right SP terminal 114*h*.

An operation of the third embodiment will be described below.

(In the Case that the Surround Left Audio Signal SL and the Surround Right Audio Signal SR are Played Back)

When determining that the multichannel audio data includes the surround left audio signal SL, the controller 2 controls the switches S111*a* and S113*a* in the on state, and controls the switches S111*b* and S113*b* in the off state. Accordingly, the surround left audio signal SL is supplied from the DSP to the amplifier 112*a* through the switch S111*a*, amplified by the amplifier 112*a*, and supplied to the surround left SP terminal 114*a* through the switch S113*a*.

When determining that the multichannel audio data includes the surround right audio signal SR, the controller 2 controls the switches S111*e* and S113*f* in the on state, and controls the switches S111*f* and S113*g* in the off state. Accordingly, the surround right audio signal SR is supplied from the DSP to the amplifier 112*c* through the switch S111*e*, amplified by the amplifier 112*c*, and supplied to the surround right SP terminal 114*e* through the switch S113*f*.

(In the Case that the Surround Back Left Audio Signal SBL and The Surround Back Right Audio Signal SBR are Played Back)

When determining that the multichannel audio data includes the surround back left audio signal SBL, the controller 2 controls the switches S111*c* and S113*c* in the on state, and controls the switches S111*d*, S113*d*, and S113*e* in the off state. Accordingly, the surround back left audio signal SBL is supplied from the DSP to the amplifier 112*b* through the switch S111*c*, amplified by the amplifier 112*b*, and supplied to the surround back left SP terminal 114*b* through the switch S113*c*.

When determining that the multichannel audio data includes the surround back right audio signal SBR, the controller 2 controls the switches S111*g* and S113*h* in the on state, and controls the switches S111*h*, S113*i*, and S113*j* in the off state. Accordingly, the surround back right audio signal SBR is supplied from the DSP to the amplifier 112*d* through the switch S111*g*, amplified by the amplifier 112*d*, and supplied to the surround back right SP terminal 114*f* through the switch S113*h*.

(In the Case that the Left Outside Audio Signal LW and the Right Outside Audio Signal RW are Played Back)

When determining that the multichannel audio data includes the left outside audio signal LW, the controller 2 controls the switches S111*c* and S113*d* in the on state, and controls the switches S111*d*, S113*c*, and 113*e* in the off state. Accordingly, the left outside audio signal LW is supplied from the DSP to the amplifier 112*b* through the switch S111*c*, amplified by the amplifier 112*b*, and supplied to the left outside/ZONE2 left SP terminal 114*c* through the switch S113*d*.

When determining that the multichannel audio data includes the right outside audio signal RW, the controller 2 controls the switches S111*g* and S113*i* in the on state, and controls the switches S111*h*, S113*h*, and S113*j* in the off state. Accordingly, the right outside audio signal RW is supplied from the DSP to the amplifier 112*d* through the switch S111*g*, amplified by the amplifier 112*d*, and supplied to the right outside/ZONE2 right SP terminal 114*g* through the switch S113*i*.

(In the Case that the Left Upside Audio Signal LH and the Right Upside Audio Signal RH are Played Back)

When determining that the multichannel audio data includes the left upside audio signal LH, the controller 2 controls the switches S111*c* and S113*e* in the on state, and controls the switches S111*d*, S113*c*, and 113*d* in the off state. Accordingly, the left upside audio signal LH is supplied from the DSP to the amplifier 112*b* through the switch S111*c*, amplified by the amplifier 112*b*, and supplied to the left upside/ZONE3 left SP terminal 114*d* through the switch S113*e*.

When determining that the multichannel audio data includes the right upside audio signal RH, the controller 2 controls the switches S111*g* and S113*j* in the on state, and controls the switches S111*h*, S113*h*, and S113*i* in the off state. Accordingly, the right upside audio signal RH is supplied from the DSP to the amplifier 112*d* through the switch S111*g*, amplified by the amplifier 112*d*, and supplied to the right upside/ZONE3 right SP terminal 114*h* through the switch S113*j*.

(In the Case that the ZONE3 Left Audio Signal Z3L and the ZONE3 Right Audio Signal Z3R are Played Back)

When determining that the playback of the ZONE3 left audio signal Z3L is set by the user manipulation, the controller 2 controls the switches S111*b* and S113*b* in the on state, and controls the switches S111*a*, S113*a*, and S113*e* in the off state. Accordingly, the ZONE3 left audio signal Z3L is supplied from the DSP to the amplifier 112*a* through the switch S111*b*, amplified by the amplifier 112*a*, and supplied to the left upside/ZONE3 left SP terminal 114*d* through the switch S113*b*.

When determining that the playback of the ZONE3 right audio signal Z3R is set by the user manipulation, the controller 2 controls the switches S111*f* and S113*g* in the on state, and controls the switches S111*e*, S113*f*, and S113*j* in the off state. Accordingly, the ZONE3 right audio signal Z3R is supplied from the DSP to the amplifier 112*c* through the switch S111*f*, amplified by the amplifier 112*c*, and supplied to the right upside/ZONE3 right SP terminal 114*h* through the switch S113*g*.

As described above, although the ZONE3 left audio signal Z3L and the surround left audio signal SL cannot simultaneously be played back, the ZONE3 left audio signal Z3L is output from not the surround left SP terminal 114*a* but the left upside/ZONE3 left SP terminal 114*d*. That is, the surround left SP terminal 114*a* is the dedicated speaker terminal for playing back the surround left audio signal SL. Accordingly, in order to play back the ZONE3 left audio signal Z3L, it is not necessary to release the connection of the surround left speaker SSL having the high use frequency. Similarly, although the ZONE3 right audio signal Z3R and the surround right audio signal SR cannot simultaneously be played back, the ZONE3 right audio signal Z3R is output from not the surround right SP terminal 114*e* but the right upside/ZONE3 right SP terminal 114*h*. That is, the surround right SP terminal 114*e* is the dedicated speaker terminal for playing back the surround right audio signal SR. Accordingly, in order to play back the ZONE3 right audio signal Z3R, it is not necessary to release the connection of the surround right speaker SSR having the high use frequency.

The ZONE2 left audio signal Z2L (or the left outside audio signal LW) can be played back while the ZONE3 left audio signal Z3L is played back. Similarly the ZONE2 right audio signal Z2R (or the right outside audio signal RW) can be played back while the ZONE3 right audio signal Z3R is played back.

(In the Case that the ZONE2 Left Audio Signal Z2L and the ZONE2 Right Audio Signal Z2R are Played Back)

When determining that the playback of the ZONE2 left audio signal Z2L is set by the user manipulation, the controller 2 controls the switches S111*d* and S113*d* in the on state, and controls the switches S111*c*, S113*c*, and S113*e* in the off state. Accordingly, the ZONE2 left audio signal Z2L is supplied from the DSP to the amplifier 112*b* through the switch S111*d*, amplified by the amplifier 112*b*, and supplied to the left outside/ZONE2 left SP terminal 114*c* through the switch S113*d*.

When determining that the playback of the ZONE2 right audio signal Z2R is set by the user manipulation, the controller 2 controls the switches S111*h* and S113*i* in the on state, and controls the switches S111*g*, S113*h*, and S113*j* in the off state. Accordingly, the ZONE2 right audio signal Z2R is supplied from the DSP to the amplifier 112*d* through the switch S111*h*, amplified by the amplifier 112*d*, and supplied to the right outside/ZONE2 right SP terminal 114*g* through the switch S113*i*.

Figure 14:
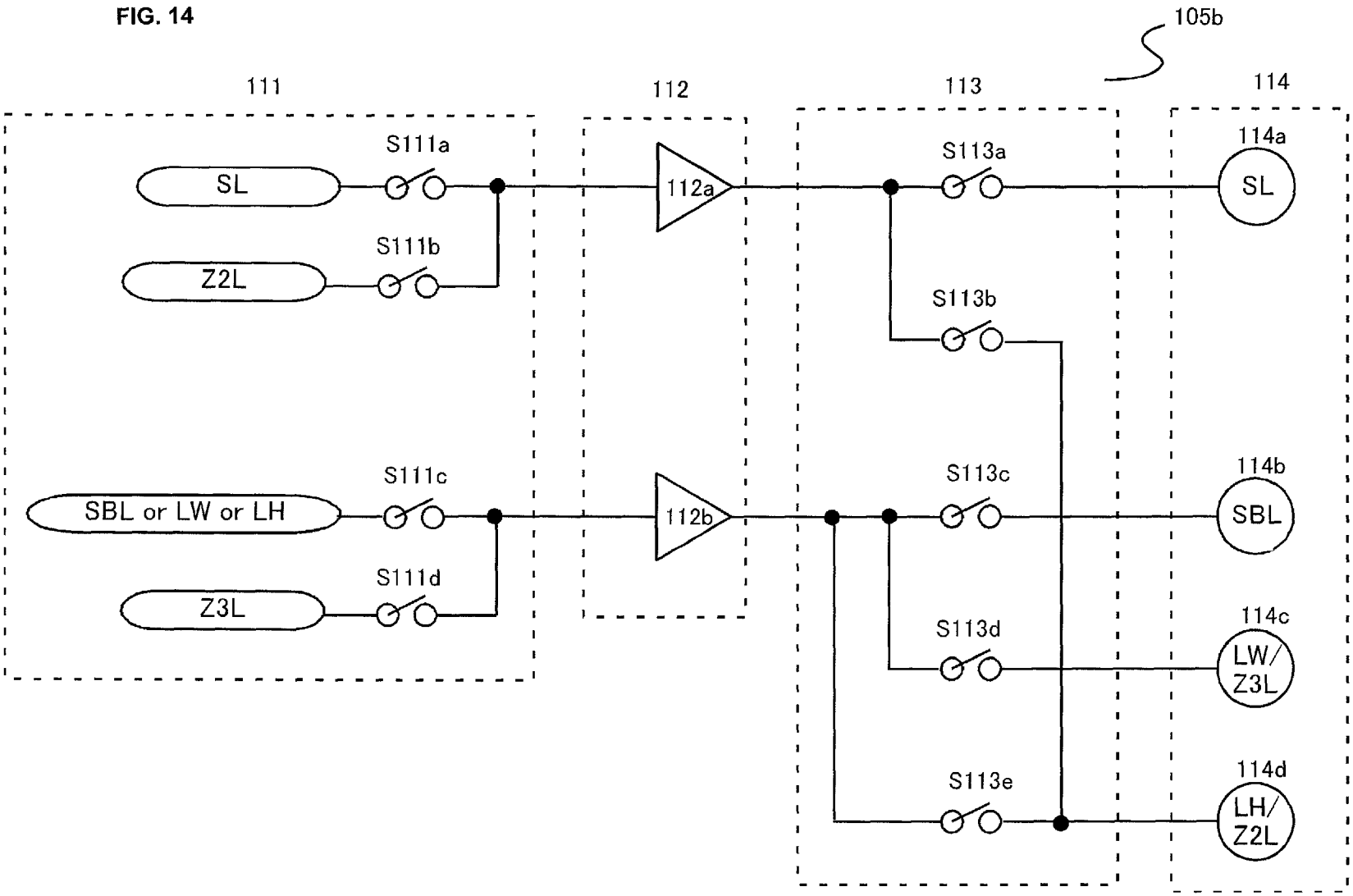
FIG. 14 is a view illustrating the audio processing unit.
Figure 15:
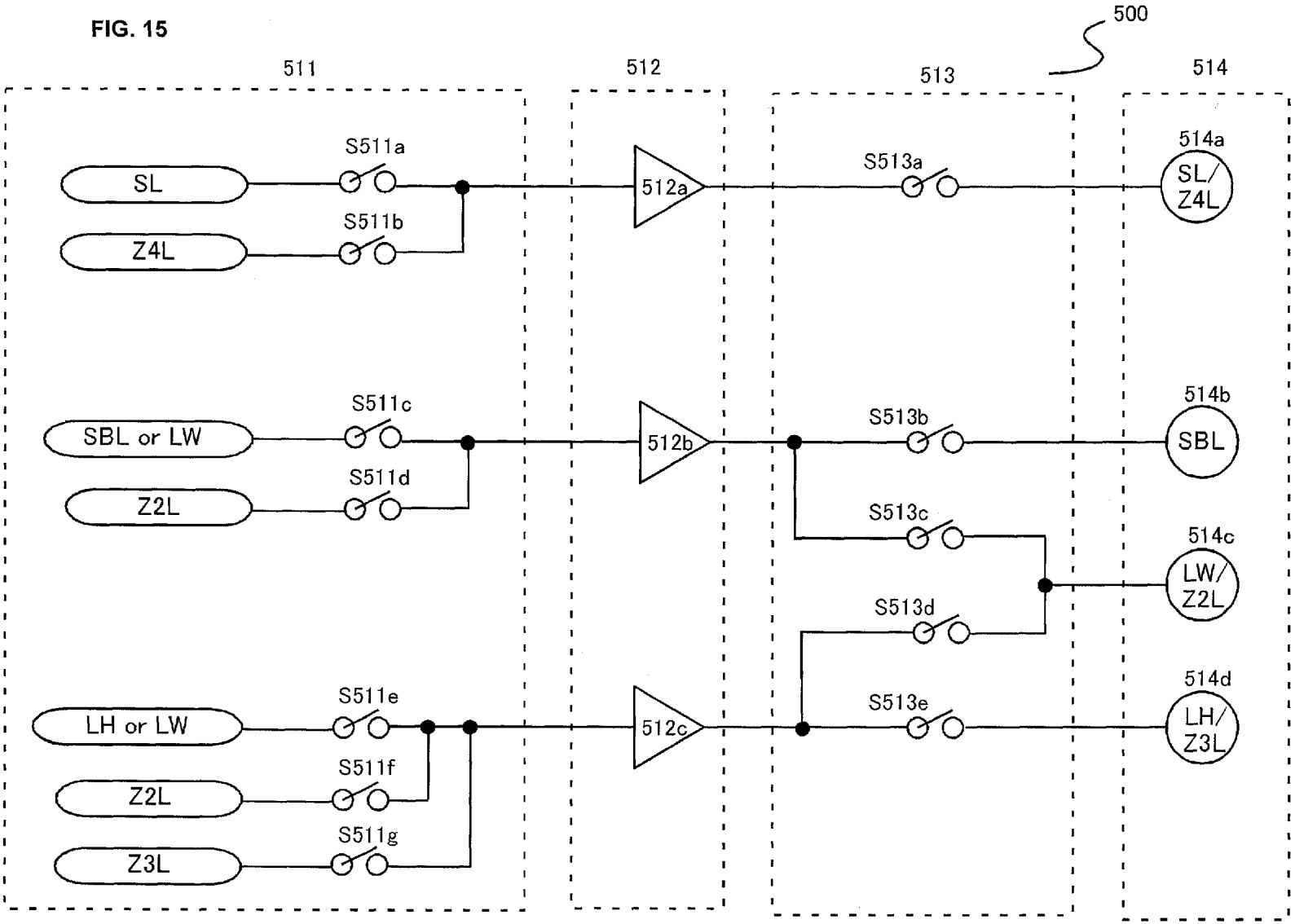
FIG. 15 is a view illustrating an audio processing unit of the related art.
Figure 16:
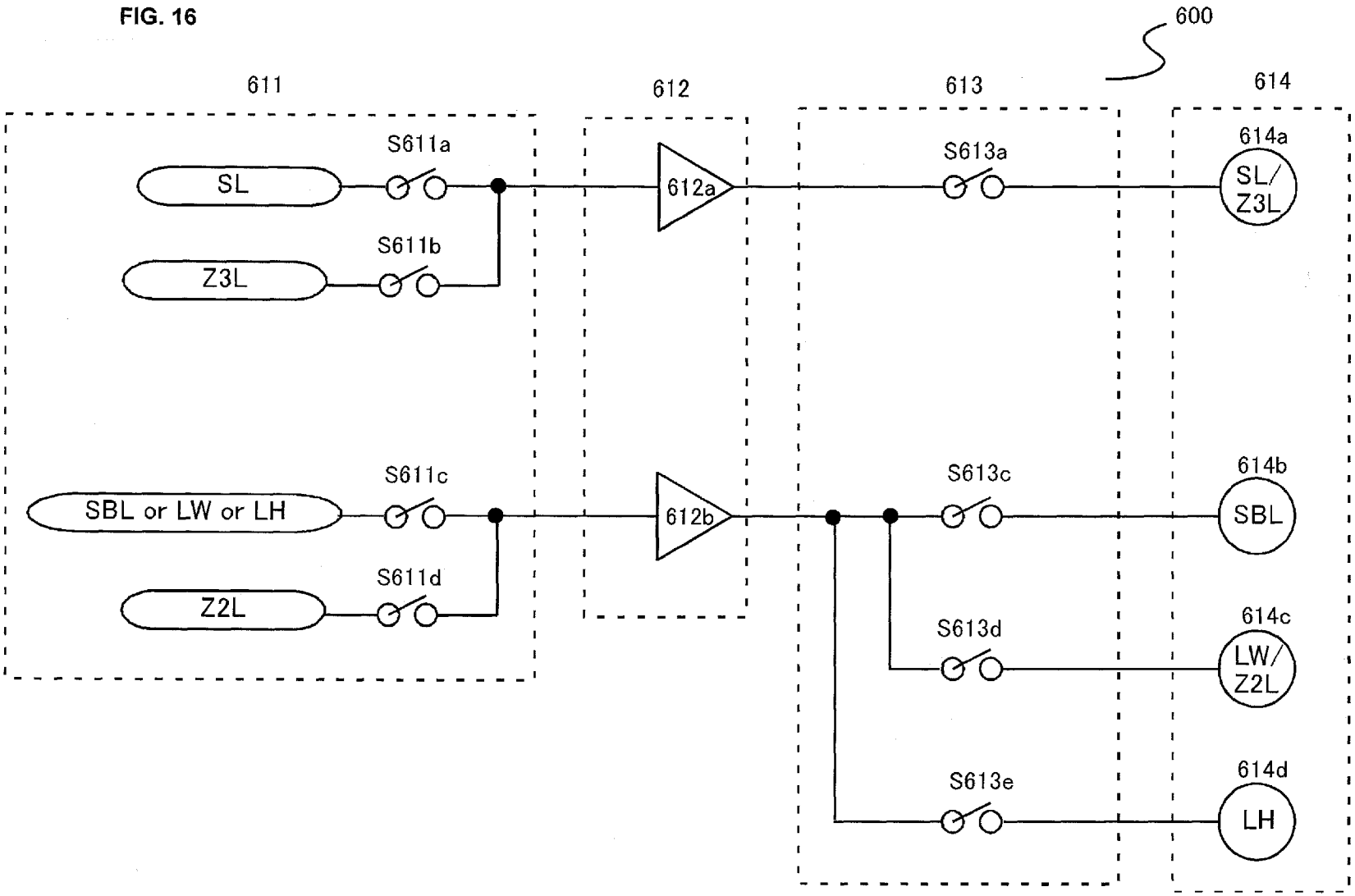
FIG. 16 is a view illustrating the audio processing unit of the related art.

As illustrated in FIG. 14, the ZONE2 left audio signal Z2L and the ZONE3 left audio signal Z3L may be exchanged for each other. That is, the numerical characters of ZONE2 and ZONE3 have no particular meaning, but the numerical characters are added for the sake of convenience. Therefore, it is noted that a modification or a change in which the numerical characters are exchanged for each other is included in the scope of the present invention. The surround back left audio signal SBL, the left outside audio signal LW, and the left upside audio signal LH may be exchanged for one another.

The embodiments of the present invention are described above, the present invention is not limited to the embodiments. A program that makes a computer to execute the operation of the AV amplifier and a recording medium in which the program is recorded may be provided.

The present invention is suitably applied to the AV amplifier and the like.

What is claimed is:

1. An audio processing apparatus comprising: a first amplifier that amplifies a surround audio signal or a fourth room audio signal, the surround audio signal being a surround left audio signal or a surround right audio signal, and the fourth room audio signal being a fourth room left audio signal or a fourth room right audio signal; a second amplifier; a third amplifier; a first speaker terminal that outputs the surround audio signal; a second speaker terminal that outputs a first extended audio signal or the fourth room audio signal, the first extended audio signal being a first extended left audio signal or a first extended right audio signal; a third speaker terminal that outputs a second extended audio signal or a second room audio signal, the second extended audio signal being a second extended left audio signal or a second extended right audio signal, and the second room audio signal being a second room left audio signal or a second room right audio signal; a fourth speaker terminal that outputs a third extended audio signal or a third room audio signal, the third extended audio signal being a third extended left audio signal or a third extended right audio signal, and the third room audio signal being a third room left audio signal or a third room right audio signal; a first switch that switches whether the surround audio signal from the first amplifier is supplied to the first speaker terminal; a second switch that switches whether the fourth room audio signal from the first amplifier is supplied to the second speaker terminal; a third switch that switches whether the amplified first extended audio signal is supplied to the second speaker terminal; a fourth switch that switches whether the amplified second extended audio signal or the amplified second room audio signal is supplied to the third speaker terminal; a fifth switch that switches whether the amplified third extended audio signal or the amplified third room audio signal is supplied to the fourth speaker terminal; and a switching controller that controls the first switch, the second switch, the third switch, the fourth switch, and the fifth switch.

2. An audio processing apparatus comprising: a first amplifier that amplifies a surround audio signal or a third room audio signal, the surround audio signal being a surround left audio signal or a surround right audio signal, and the third room audio signal being a third room left audio signal or a third room right audio signal; a second amplifier that amplifies a first extended audio signal, a second extended audio signal, a third extended audio signal, or a second room audio signal, the first extended audio signal being a first extended left audio signal or a first extended right audio signal, the second extended audio signal being a second extended left audio signal or a second extended right audio signal, the third extended audio signal being a third extended left audio signal or a third extended right audio signal, and the second room audio signal being a second room left audio signal or a second room right audio signal; a first speaker terminal that outputs the surround audio signal; a second speaker terminal that outputs the first extended audio signal; a third speaker terminal that outputs the second extended audio signal or the second room audio signal; a fourth speaker terminal that outputs the third extended audio signal or the third room audio signal; a first switch that switches whether the surround audio signal from the first amplifier is supplied to the first speaker terminal; a second switch that switches whether the third room audio signal from the first amplifier is supplied to the fourth speaker terminal; a third switch that switches whether the first extended audio signal from the second amplifier is supplied to the second speaker terminal; a fourth switch that switches whether the second extended audio signal or the second room audio signal from the second amplifier is supplied to the third speaker terminal; a fifth switch that switches whether the third extended audio signal from the second amplifier is supplied to the fourth speaker terminal; and a switching controller that controls the first switch, the second switch, the third switch, the fourth switch, and the fifth switch.

3. The audio processing apparatus according to claim 1, wherein the first extended left audio signal is any one of a surround back left audio signal, a left outside audio signal, a left upside audio signal, and a left-central-side audio signal, the first extended right audio signal is any one of a surround back right audio signal, a right outside audio signal, a right upside audio signal, and a right-central-side audio signal, the second extended left audio signal is any one of the surround back left audio signal, the left outside audio signal, the left upside audio signal, and the left-central-side audio signal and is different from the first extended left audio signal, the second extended right audio signal is any one of the surround back right audio signal, the right outside audio signal, the right upside audio signal, and the right-central-side audio signal and different from the first extended right audio signal, the third extended left audio signal is any one of the surround back left audio signal, the left outside audio signal, the left upside audio signal, and the left-central-side audio signal and different from the first extended left audio signal and the second extended left audio signal, and the third extended right audio signal is any one of the surround back right audio signal, the right outside audio signal, the right upside audio signal, and the right-central-side audio signal and different from the first extended right audio signal and the second extended right audio signal.

* * * * *